US007163016B2

(12) United States Patent
Kingsford et al.

(10) Patent No.: US 7,163,016 B2
(45) Date of Patent: Jan. 16, 2007

(54) MATERIAL DISPENSER WITH APPLICATOR

(75) Inventors: Thaddeus I. Kingsford, Orlando, FL (US); Michael M. Malvar, Oceanside, NY (US); Volker Schrepf, East Islip, NY (US)

(73) Assignee: Henlopen Manufacturing Co., Inc., Melville, NY (US)

( * ) Notice: Subject to any disclaimer, the term of this patent is extended or adjusted under 35 U.S.C. 154(b) by 0 days.

(21) Appl. No.: 09/765,132

(22) Filed: Jan. 18, 2001

(65) Prior Publication Data

US 2001/0032656 A1 Oct. 25, 2001

Related U.S. Application Data

(60) Provisional application No. 60/190,892, filed on Mar. 21, 2000, provisional application No. 60/177,726, filed on Jan. 21, 2000.

(51) Int. Cl.
*A45D 33/24* (2006.01)

(52) U.S. Cl. ..... 132/294; 401/125

(58) Field of Classification Search ..... 132/294, 132/293, 295, 297, 298, 300, 303, 313, 314, 132/317, 318, 320; 401/123, 125, 127, 129, 401/89, 140; 15/104.8; 206/581, 235, 361; D28/78, 85

See application file for complete search history.

(56) References Cited

U.S. PATENT DOCUMENTS

| | | | | | |
|---|---|---|---|---|---|
| 505,823 | A | | 10/1893 | Faber | |
| 1,512,799 | A | * | 10/1924 | Reid | 132/75 |
| 2,214,437 | A | * | 9/1940 | Punte et al. | 206/536 |
| 2,215,480 | A | * | 9/1940 | Sampson | 132/306 |
| 2,236,240 | A | * | 3/1941 | Lowen | 401/99 |
| 2,783,875 | A | * | 3/1957 | Shabarick | 312/35 |
| 2,951,489 | A | | 9/1960 | Roberts | |
| 3,397,707 | A | * | 8/1968 | Aversa | 132/317 |
| 3,502,089 | A | | 3/1970 | Paradis | |
| 3,503,089 | A | * | 3/1970 | Paradis | 132/294 |
| 3,760,820 | A | * | 9/1973 | Seidler | 132/317 |
| 4,579,133 | A | * | 4/1986 | Seidler | 132/85 |
| 4,679,692 | A | * | 7/1987 | Davey | 206/581 |
| 4,726,387 | A | | 2/1988 | Sarica | |
| 4,750,501 | A | | 6/1988 | Ackermann et al. | |
| 4,777,969 | A | * | 10/1988 | Holloway | 132/314 |
| 5,056,179 | A | | 10/1991 | Capponi | |
| 5,135,112 | A | * | 8/1992 | Kamen et al. | 206/581 |
| 5,137,387 | A | | 8/1992 | Byrd et al. | |
| D333,535 | S | * | 2/1993 | Kamen et al. | D28/78 |
| 5,205,301 | A | * | 4/1993 | Nakamura | 132/320 |
| 5,437,294 | A | * | 8/1995 | Ebbets, III et al. | 132/304 |
| 5,655,553 | A | * | 8/1997 | Giese et al. | 132/303 |
| 5,836,319 | A | | 11/1998 | Lombardi | |
| 6,002,651 | A | * | 12/1999 | Baccaray | 368/10 |
| 6,073,634 | A | * | 6/2000 | Gueret | 132/218 |

(Continued)

FOREIGN PATENT DOCUMENTS

| | | |
|---|---|---|
| EP | 0261750 | 7/1993 |

(Continued)

*Primary Examiner*—Eduardo C. Robert
*Assistant Examiner*—David Comstock
(74) *Attorney, Agent, or Firm*—Cooper & Dunham LLP

(57) ABSTRACT

A dispenser for material including an applicator, an elongated housing member with a well at one end thereof for receiving the applicator to shield the applicator, a laterally opening receptacle carried by the housing member for holding a coherent body of the material to be dispensed and applied, and structure carried by or forming a part of the housing member for closing the receptacle to shield the material.

4 Claims, 19 Drawing Sheets

U.S. PATENT DOCUMENTS

| | | | |
|---|---|---|---|
| 6,309,124 | B1 | 10/2001 | Gueret |
| 2002/0108629 | A1 | 8/2002 | Thiebaut |
| 2003/0168076 | A1 | 9/2003 | Vieu et al. |

FOREIGN PATENT DOCUMENTS

| | | | |
|---|---|---|---|
| EP | 0960582 | | 12/1999 |
| EP | 1020135 | | 7/2000 |
| FR | 1020647 | | 2/1953 |
| FR | 2 759 872 | A | 8/1998 |
| FR | 2759872 | | 8/1998 |
| GB | 2 103 083 | A | 2/1983 |
| GB | 2139886 | | 11/1984 |
| JP | 60-168404 | | 8/1985 |
| JP | 3-128016 | | 12/1991 |
| JP | 8-154738 | | 6/1996 |
| JP | 2000-232913 | | 8/2000 |

* cited by examiner

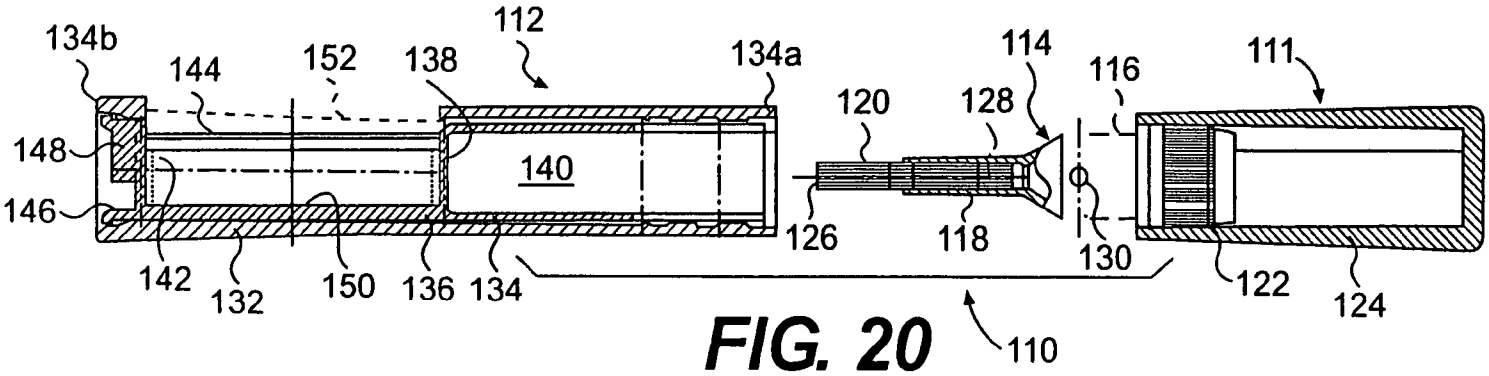
FIG. 20
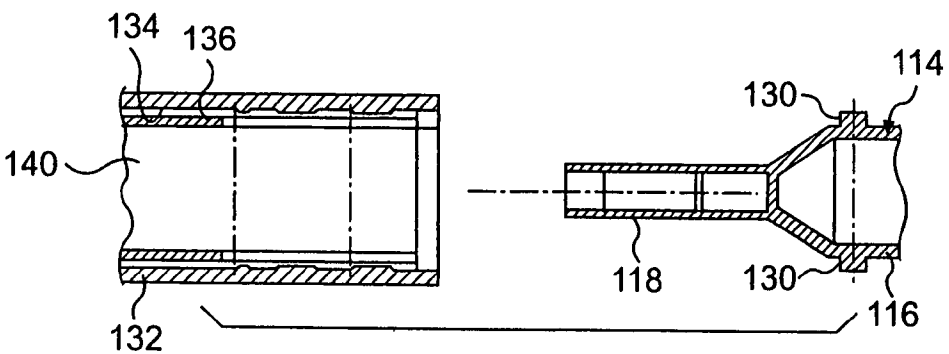
FIG. 21
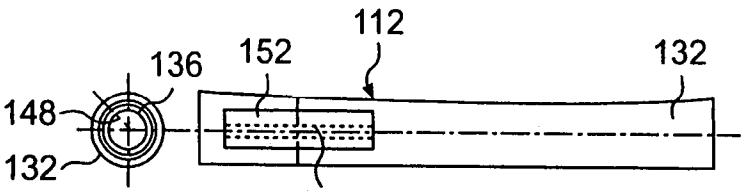
FIG. 22
FIG. 23

MATERIAL DISPENSER WITH APPLICATOR

CROSS-REFERENCE TO RELATED APPLICATIONS

This application claims the benefit of U.S. provisional applications No. 60/177,726, filed Jan. 21, 2000, and No. 60/190,892, filed Mar. 21, 2000, under Title 35, United States Code, Section 119(e).

BACKGROUND OF THE INVENTION

This invention relates to dispensers for material which is in the form of a coherent body and is to be applied locally or topically to a selected area of a surface. More particularly, the invention relates to dispensers of the type described including a container for the coherent body and an applicator for transporting quantities of the material therefrom to the selected surface area to which the material is to be applied. In a still more specific sense, the invention is directed to portable, e.g. hand-held, dispensers in which the applicator is manipulable by the human hand.

The term "material in the form of a coherent body" refers to materials that are not in a free-flowing liquid state or condition, but are able to retain their shape as a contained mass or body in a tub or receptacle against gravitational force, though they may be relatively soft, pasty or otherwise pliable and are able to be picked up by an applicator drawn across a surface of the mass or body. Non-limiting examples of such materials are lipsticks and like soft, pasty but semi-solid formulations, and compressed powders.

In its broader aspects, the invention embraces dispensers for a wide variety of products and uses, including, without limitation, materials employed in arts and crafts work for application to paper, wood, metal, plastic, etc., as well as therapeutic and cosmetic materials for application to the face or skin, e.g., lip colorants, eye shadows, blushes, concealers, mascaras, medical ointments and treatments, etc. For purposes of specific illustration but not limitation, detailed reference will be made herein to containers and applicators for lip cosmetic products such as lip colorants.

One of the most popular and most used forms of cosmetics is the lipstick. It is a soft mass of a colorant in stick form applied to the lips. Because it is applied to the soft flesh of the lips, softness in the formulation is an important criterion. Various agents and emollients are added to the wax base to assure smooth and easy application.

Owing to this important and necessary attribute, lipstick in stick form may break easily in the application process. Therefore, to insure structural stability and strength, the stick diameter commonly has a diameter of about one-half inch, although the diameter may vary to a greater or lesser extent. While some lipsticks are considerably smaller in diameter, they suffer the disadvantage of harder formulation and thus lose the efficacious and desirable attribute of the larger diameter. On the other hand, the larger diameter, though generally used and accepted, has the disadvantage of being difficult to clearly delineate the outer edges of the lips. While manufacturers mold a variety of stick forms with sharp edges and perimeters, these edges disappear quickly in use and the stick end becomes a rounded mound with no ability for sharp definition.

Users have tried to solve this problem by employing a small artist brush to edge the lips. They cover the large area of the lips with the stick and then coat the brush from the stick and finish the application by lining or outlining with the brush. This solution, however, is unsatisfactory, owing to the need, first, to find a brush, and then to cover the bristles when not in use; moreover, the brush is not readily portable. To meet the need thus presented, some commercial producers have provided a small brush with a covering cap that could be carried in the purse; but this expedient gives the user four parts to deal with: the lipstick and cap and the brush and cap. Most often these components are not sealed from the air and are therefore subject to drying and a decrease in fluidity and effectiveness.

Another form of lip color applicator currently commercially available is the pencil, a small diameter lip colorant encased most commonly in wood but also in some instances in plastic or metal. A disadvantage of the pencil is that (as in the case of stick-form lipstick) the tip quickly rounds off and loses its point in use. Moreover, because the "lead" of the pencil is an exposed and unsupported body of cosmetics formula, the "lead" breaks easily and often, and it is most difficult to keep a point. No successful sharpener has been devised to sharpen a soft formula encased in the hardness of wood or plastic; one or the other suffers, and most often it is the lip colorant, which breaks. In the case of double ended pencils that offer a large diameter colorant at one end and a small diameter colorant, for lining, on the other, the formulation of the small diameter colorant has to be relatively hard (with reduced efficacy of application) to minimize breakage of the exposed and unsupported point. In addition, no stick of a lip color can match the sharpness or precision of a brush.

Similar problems have been encountered in the case of other cosmetics products that may be applied in the form of a stick or pencil, such as eye shadows, eye liners and brow liners, as well as creams and powders.

SUMMARY OF THE INVENTION

The present invention in a first aspect broadly contemplates the provision of a dispenser for material which is in the form of a coherent body and is to be applied to a surface, comprising a manipulable applicator unit including an applicator for the material; and a material container unit having proximal and distal ends and comprising an assembly including a well, opening through the proximal end of the unit, in which the applicator is removably insertable, for storing and shielding the applicator; a receptacle with an open side, disposed distally of the well and opening laterally of the unit, for holding a coherent body of the material; and a cover manually movable relative to the receptacle for opening and closing the receptacle, the receptacle when open providing access for the applicator to be brought into contact with material of the coherent body.

"Proximal" and "distal," as used herein, respectively refer to the ends of the dispenser adjacent and remote from a user's hand which is grasping the applicator unit while the applicator is seated in the well. "Manipulable applicator unit" means a unit, typically including a handle as well as the applicator per se, that may be grasped and manipulated by the human hand or fingers for picking up, transporting and applying to a surface a quantity of material.

Conveniently or preferably, the container unit includes a housing member having a proximal portion and a distal portion. The well may be formed in the proximal portion of the housing member. The distal portion of the housing member may be hollow and may open through the distal end of the unit to constitute the cover, and, in such case, the receptacle may comprise a drawer slidable completely into and at least partially out of the hollow distal portion of the housing member through the distal end of the unit.

Alternatively, the distal portion of the housing member may have a side wall with a lateral opening formed therein. The receptacle may be mounted in the distal portion of the housing member with its open side in register with the lateral opening, the cover being carried by the housing and manually moveable relative thereto. Thus, the cover may be hingedly mounted on the housing member, or the cover may be a sleeve rotatably surrounding at least the distal portion of the housing member and having a lateral sleeve opening such that rotation of the sleeve moves the sleeve opening into and out of register with the lateral opening of the housing member. Alternatively, the receptacle may be disposed within the hollow distal portion of the housing member (which, in this instance, constitutes the cover) so as to be manually rotatable relative thereto to move the open side of the receptacle into and out of register with the lateral opening of the housing member, the receptacle being provided with a manually graspable portion to enable manual rotation of the receptacle relative to the housing member.

In still further and currently preferred embodiments of the invention, wherein the housing member again serves as the cover, the housing member has a generally cylindrical hollow interior extending between and opening through the proximal and distal ends of the unit, and the receptacle and well are respectively formed as distal and proximal portions of an integral elongated inner member inserted within and extending from end to end of the hollow interior, the housing member and the inner member having a common long axis and the inner member being rotatable relative to the housing member about the common long axis. Advantageously, in these embodiments, the applicator unit includes at least one projection disposed to engage the proximal portion of the inner member for rotating the inner member between positions in which the open side of the receptacle is respectively in and out of register with the lateral opening of the housing member. This projection is a laterally projecting nib, and the proximal portion of the inner member may have a proximal edge formed with a notch or slot for receiving the nib. Typically or preferably, two such nibs, and two cooperating notches or slots, are provided, 180° apart.

As a further particular feature of advantage or preference, in these embodiments, each nib is dimensioned to project laterally outwardly of its associated inner member notch or slot when the applicator is inserted in the well; and the housing member has a proximal inner wall portion, surrounding the well, formed internally with a groove or ridge engageable with the nib or nibs for retaining the applicator in the well. In one specific embodiment, the housing member is formed internally with a helical groove or thread such that the applicator unit is secured to the housing member by threaded engagement when the applicator is inserted in the well, and the threaded engagement and disengagement of the applicator unit with the housing unit serve to rotate the inner member to close and open the receptacle by turning the open side wall of the receptacle respectively out of and into register with the lateral opening of the housing member.

In addition, the inner member and the housing member may have mutually engageable stop portions for arresting rotation of the inner member relative to the housing member at extremities of rotary position at which the open side wall of the receptacle is respectively entirely out of, and in, register with the lateral opening of the housing member. Advantageously, the respective stop portions of the inner member and the housing member interengage with a click to releasably lock the inner member relative to the housing member at each of the aforesaid extremities of rotary position.

If desired, in any of the foregoing embodiments, the cover and/or an externally visible portion of the receptacle may be transparent to enable viewing of cosmetic material contained in the receptacle.

Stated somewhat differently, the invention in certain of its aforementioned currently preferred embodiments specifically embraces dispensers for material which include a tubular and open-ended housing member having opposed proximal and distal extremities and a lateral opening; an inner member, including a receptacle having an open side for holding a body of material, disposed within the housing member for rotation relative thereto between positions in which the open side of the receptacle is respectively in and out of register with the lateral opening of the housing member; and a manipulable applicator unit, including an applicator for material, insertable in the proximal extremity of the housing member so as to seat removably therein; the applicator unit and the inner member having mutually engageable portions for transmitting rotary motion of the applicator unit to the inner member to rotate the inner member between the aforesaid positions when the applicator unit is at least partially inserted in the proximal end of the housing member.

In an additional aspect, the invention embraces a package of material comprising, in combination, the above-described dispenser and a coherent body of material contained in the receptacle.

By virtue of the described features, the invention provides a single, portable, easily operable unit containing both a coherent body of material to be applied to a surface and an applicator for precise application of the material to a desired surface, wherein both the applicator and the contained material are shielded but readily accessible for use. For at least many specific uses, the unit is advantageously shaped and dimensioned to be small and portable, readily fitting in a user's purse or pocket.

Further features and advantages of the invention will be apparent from the detailed description hereinbelow set forth, together with the accompanying drawings.

BRIEF DESCRIPTION OF THE DRAWINGS

FIG. 20 is an exploded side elevational sectional view of another cosmetic dispenser embodying the invention;

FIG. 21 is a fragmentary enlarged view similar to FIG. 20, but with the applicator rotated 90° about its long axis to show the shape and disposition of the nibs;

FIG. 22 is a plan view, at a smaller scale, of the container unit of the embodiment of FIG. 20;

FIG. 23 is a distal end view of the same container unit;

DETAILED DESCRIPTION

Figure 1:
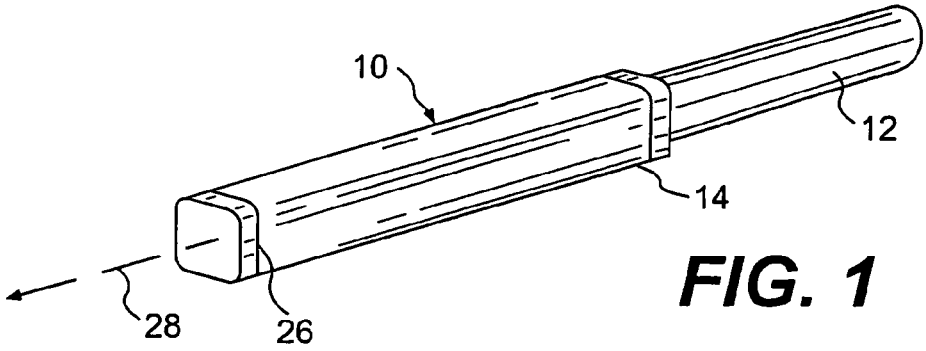
FIG. 1 is a perspective view of a lip colorant dispenser embodying the present invention in a particular form.
Figure 2:
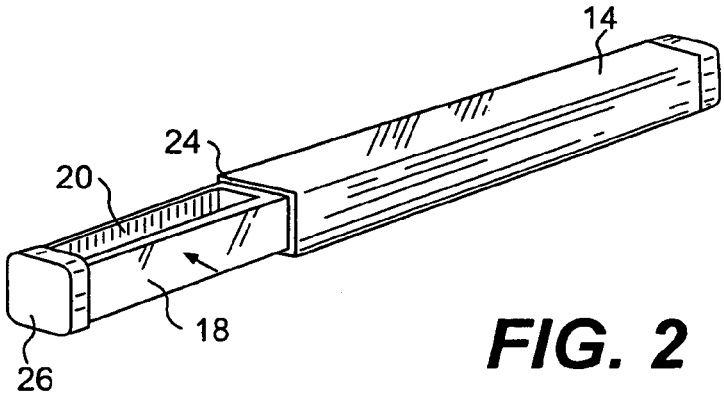
FIG. 2 is a similar view of the housing member of the embodiment of FIG. 1.

Stated generally, the types of materials with which the dispenser of the invention may be employed include those which are capable of forming a coherent body as described above, and which are intended to be applied, typically in a more or less precise manner, to a selected and limited area or region of a surface, using an applicator manipulated by the human hand. A further characteristic of such materials is that when the applicator is brought into moving, brushing or rubbing contact with an exposed surface of the coherent body, the applicator picks up a quantity of the material for transport and delivery to the selected surface region.

The invention will be particularly described, for purposes of illustration but not limitation, as embodied in dispensers for lip colorant, but it is to be understood that the dispensers of the invention may also be used for other types of cosmetic materials, e.g., eye shadows, eye liners, brow liners, creams and compressed powders, as well as therapeutic or medicinal materials to be applied to a skin or body portion surface, and materials for application to nonliving substrates such as paper, wood, plastic, or metal, as in arts and crafts projects.

Referring first to FIGS. 1–5, the dispenser 10 there shown includes an applicator, exemplified in this embodiment by a bristle brush 11, mounted at the distal end of an elongated handle 12 to constitute a manipulable applicator unit, and a container unit comprising an elongated, axially rectilinear hollow housing member 14 having at one end (herein termed the proximal end of the container unit) a well 16 for receiving the brush 11. An elongated drawer 18, dimensioned to slide lengthwise into and out of the hollow interior of the housing member 14 through the distal end of the housing member (i.e., the end of the container unit remote from the well 16), serves as a cosmetic material receptacle. This drawer, open laterally along one side as indicated at 20, receives a coherent body of lip colorant (not shown) for application to a user's lips.

Figure 3:
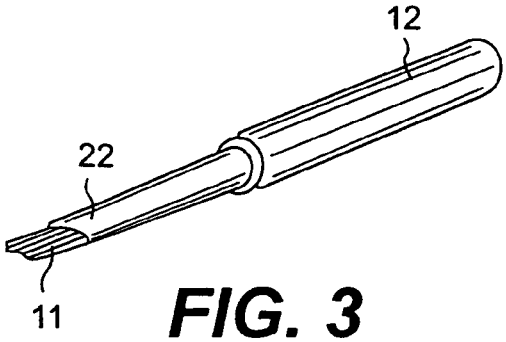
FIG. 3 is a view of the brush and handle of the embodiment of FIG. 1.
Figure 4:
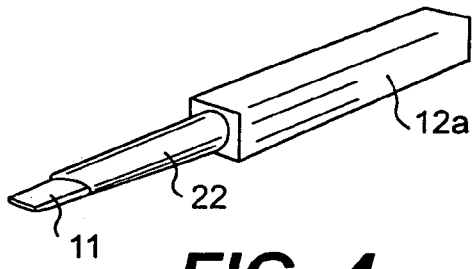
FIG. 4 is a similar view of an alternative form of the brush and handle for use in the embodiment of FIG. 1.
Figure 5:
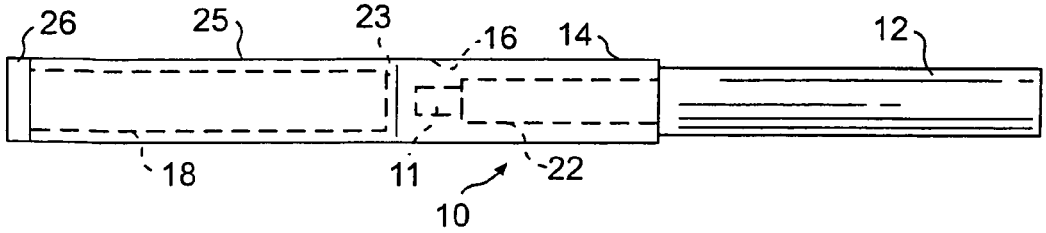
FIG. 5 is a side elevational view of the embodiment of FIG. 1, with the interior structure indicated in phantom outline.

The brush handle, housing member and drawer are conveniently all substantially rigid molded plastic members, as is conventional for portable cosmetic containers and dispensers, although one or more of them may be fabricated wholly or partly of other material, e.g. metal, if desired. Illustrative though non-limiting dimensions for the dispenser 10 are a length of about six inches and a minimum cross-section of about one-half inch. The handle 12 may be cylindrical as indicated in FIGS. 1 and 3, or may be replaced by a handle 12*a* of square cross-section as shown in FIG. 4.

The bristles of the brush 11, in the form shown, are substantially parallel to each other, with free outer ends, their other ends being fixedly anchored or adhered to the distal extremity of a rigid plastic rod or shaft 22 extending axially from the handle; other forms and arrangements of applicator brushes and the like may also be used, within the broad scope of the invention. When the brush is inserted within the well 16, a shoulder portion or distal end of the handle seats tightly in the mouth of the well, by press-fitting, snap-fitting, threaded or other secure engagement, so that the brush is retained within and shielded by the well and is not vulnerable to accidental dislodgment while the dispenser is being carried in a user's purse or pocket. At the same time, the engagement between the brush and the housing member is such as to permit ready extraction of the brush from the well by manipulation of the handle. Suitable arrangements as heretofore used for mounting cosmetic applicators such as brushes in mouths or necks of containers are well known in the art and accordingly need not be further described.

Within the housing member, the well is closed by a septum 23 (FIG. 5) extending entirely across the hollow housing member interior. Thus, in this embodiment, upon insertion in the well, the brush is entirely shielded from exposure to air such as might cause residual cosmetic material to dry on and undesirably stiffen or cake on the bristles of the brush between applications, the engagement of the brush handle with the mouth of the well being substantially air-tight.

The long dimension of the hollow portion of the housing member 14 between the septum 23 and the open second end 24 thereof is at least sufficient to accommodate the full length of the drawer 18. In this particular embodiment, the wall portion 25 of the housing member surrounding the hollow interior in which the drawer is inserted serves to close the receptacle to prevent exposure of the contained cosmetic to the air. The drawer has an enlarged outer end 26 serving as a stop to prevent excessive insertion of the drawer within the housing member, and to cooperate with the end 24 and side wall of the housing member in providing substantially air-tight closure of the drawer between applications. In this embodiment, the wall portion of the housing member surrounding the hollow interior in which the drawer is inserted serves to close the receptacle to prevent exposure of the contained cosmetic to the air. The relative dimensions of drawer and housing member can be selected to provide a sufficiently snug fit to prevent accidental opening of the drawer while enabling the user to open the drawer when desired by manually grasping the drawer end 26 and pulling in the direction of arrow 28, FIG. 1.

As stated, in the above-described embodiment of the invention both the applicator in the well, and the coherent body of material in the receptacle, are protected from exposure to air (between uses) by air-tight closure. However, in many embodiments of the invention it is not necessary to provide air-tight sealed closure of the applicator and/or of the coherent body of material in the container, but it is sufficient that they are shielded from contaminant particles and from damage by contact with external objects, e.g. with other articles in a handbag or pocketbook, as well as from causing staining or soiling of other objects.

The dispenser of FIG. 1 is packaged by a cosmetics manufacturer after a coherent body of lip colorant has been deposited in the drawer 18. For application of the colorant, a user grasps the handle 12, removing the brush 11 from the well 16, and opens the drawer 18 lengthwise to expose its laterally open interior containing the colorant. The user then draws the brush across the surface of the body of colorant within the drawer, which is supported and protected by the drawer structure against disintegration, thereby picking up a portion of the colorant for transport and application by the brush to the lips. These steps may be repeated until a desired application is complete, at which time the user closes the drawer, restores the brush to the well, and replaces the closed dispenser in her purse or pocket.

Figure 6:
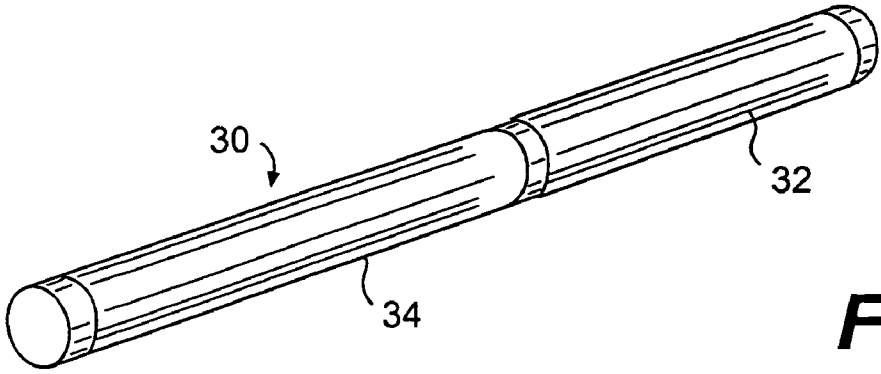
FIG. 6 is a perspective view of another lipstick dispenser embodying the invention.
Figure 7:
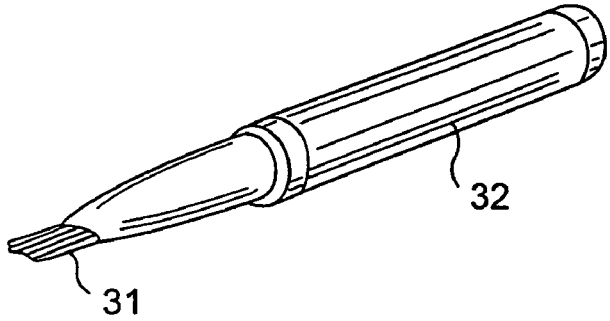
FIG. 7 is a similar view of the brush-handle of the dispenser of FIG. 6.
Figure 8:
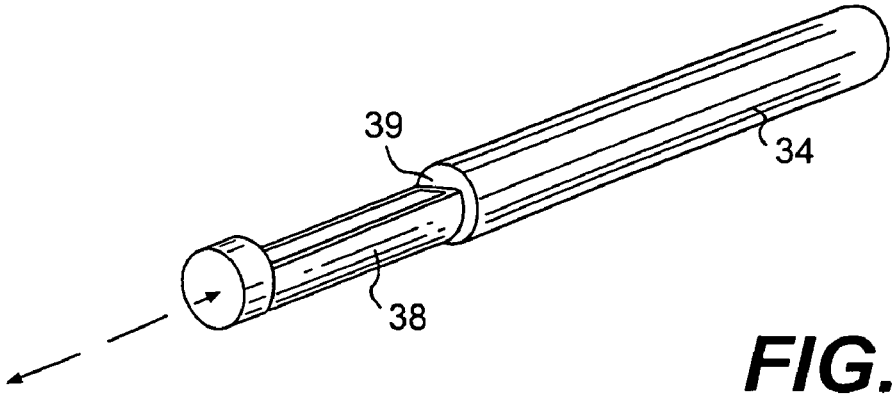
FIG. 8 is a similar view of the housing member of the dispenser of FIG. 6.

The form of dispenser 30 shown in FIGS. 6–8 is structurally and functionally similar to that of FIGS. 1–5, and includes a brush 31 with handle 32, housing member 34, and drawer 38 for lip colorant. In this case, the cross-section of the drawer is D-shaped and the end of the housing member through which the drawer is inserted has an outer wall 39 with a D-shaped opening dimensioned to admit the drawer, for enhanced shielding of the contained cosmetic from the air.

Figure 9:
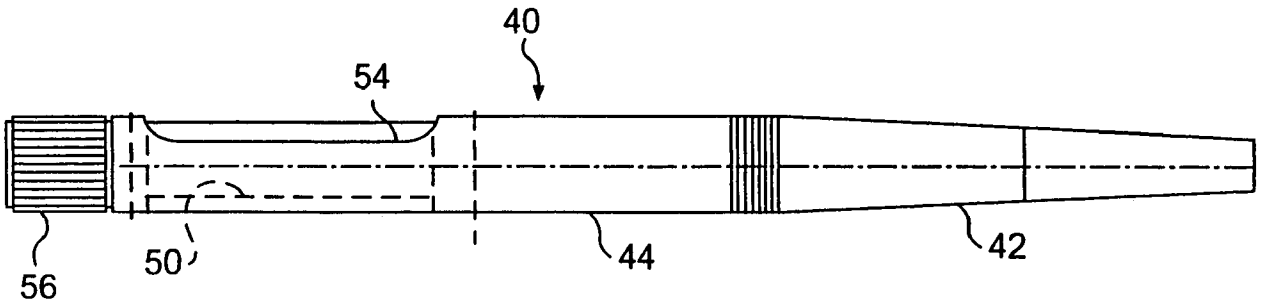
FIG. 9 is a side elevational view of a further embodiment of the invention.
Figure 10:
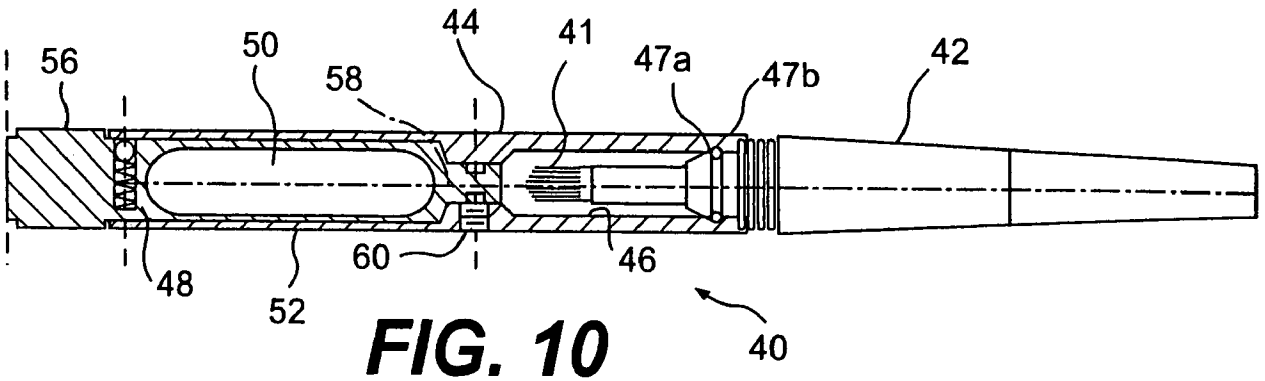
FIG. 10 is a side sectional view of the FIG. 9 embodiment.
Figure 11:
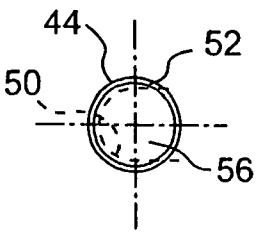
FIG. 11 is an end view of the FIG. 9 embodiment.
Figure 12:
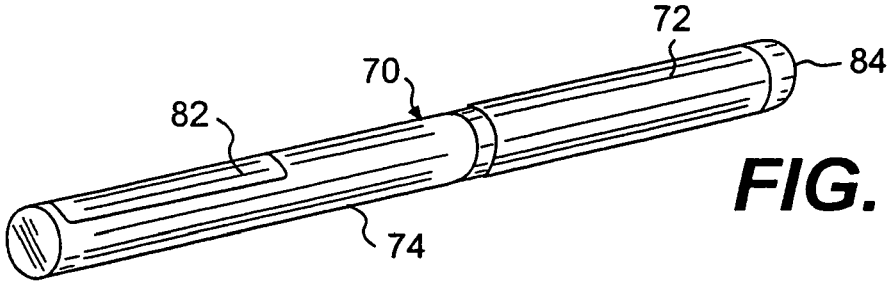
FIG. 12 is a perspective view of yet another embodiment of the invention.
Figure 13:
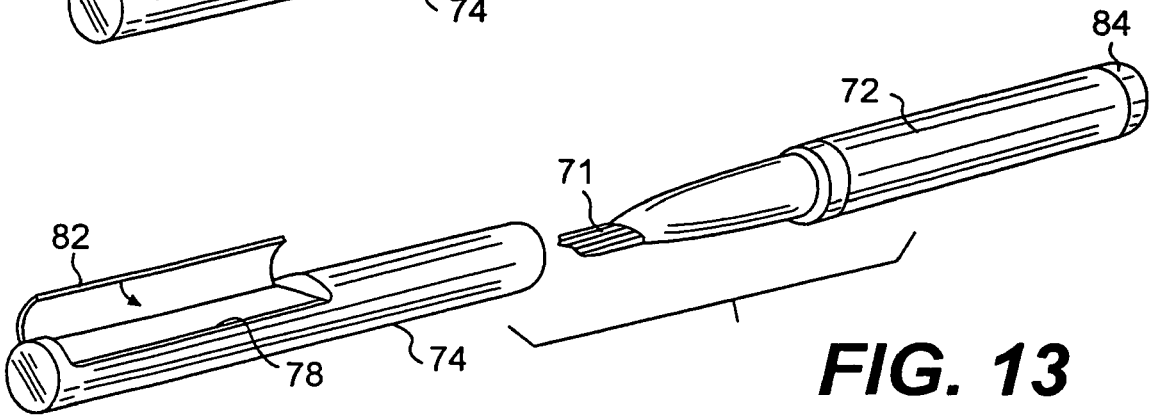
FIG. 13 is an exploded perspective view of the embodiment of FIG. 12.

FIGS. 9–11 illustrate a modified embodiment of the invention, designated dispenser 40, including a brush 41 with a handle 42, and an elongated cylindrical housing member 44 having an internally closed well 46 opening through one end for receiving the brush, which is snap-fittedly securable therein by means of interengaging beads 47*a*, 47*b*. Beyond the well, the housing member 44 is hollow and has, inserted therein, a cylindrical receptacle member 48 formed in one side with a laterally opening recess or tub 50 for holding a coherent body of cosmetic material such as lip colorant.

The receptacle member is snugly and concentrically surrounded by the outer wall portion 52 of the housing member which, as in the embodiments described above, constitutes the means for closing the receptacle to shield the contents from the air. In this embodiment, however, the receptacle member is rotatable within the housing member, about the long axis thereof, rather than being drawn lengthwise out of the housing member as in the preceding embodiments. A lateral opening 54 is formed in one side portion of the housing member wall 52, in position for register with the recess 50 when the member 48 is rotated to an appropriate angular orientation. A knurled knob 56, connected to member 48 and disposed at the end of the housing member remote from the brush well, is grasped by the user to rotate the member 48 into and out of the position in which the opening 54 is in register with the recess to expose the contained colorant.

At its inner end, the member 48 has an annularly grooved nose 58 seating in a socket portion of the housing member. A threaded retainer 60 may be mounted in the housing member so as to project within the groove of nose 58 to prevent axial movement of the member 48 relative to the housing member.

In this device, manipulation of the brush is as described with reference to the previous embodiments. For application, the user removes the brush from the well and rotates the receptacle member 48 within the housing member 44 by means of the knob until the recess 50 is in register with the opening 54, exposing the colorant for pick-up and removal by the brush. After application, the user again rotates the knob until the recess 50 is entirely out of register with the opening 56 so that the housing wall 52 shields the contents from the air, and replaces the brush in the well.

The elements of the dispenser 40, like those of the other embodiments described herein, may be substantially rigid molded plastic elements. If desired, in this and/or any of the other embodiments of the invention, the closing means (wall 52, in dispenser 40) may be made of transparent plastic to enable the contained cosmetic to be viewed when the container is closed. Alternatively, the housing member wall or other closing means, like other parts of the dispenser, may be opaque, colored and/or decoratively ornamented. Also, in any of the embodiments of the invention, the receptacle may be refillable with the cosmetic material so that the consumer does not need to buy a complete dispenser device each time the supply of cosmetic material in the receptacle is exhausted.

Figure 14:
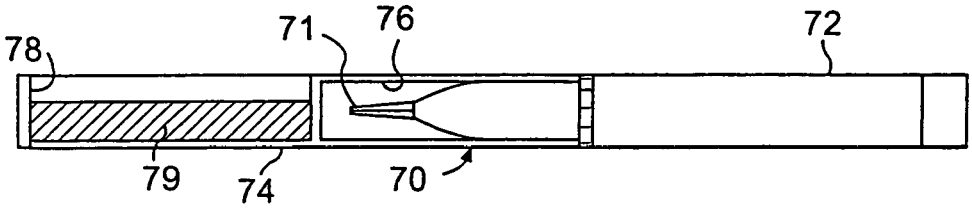
FIGS. 14 and 15 are, respectively, side and transverse sectional views of the embodiment of FIG. 12.
Figure 15:
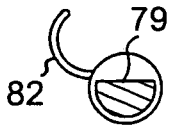
Figure 16:
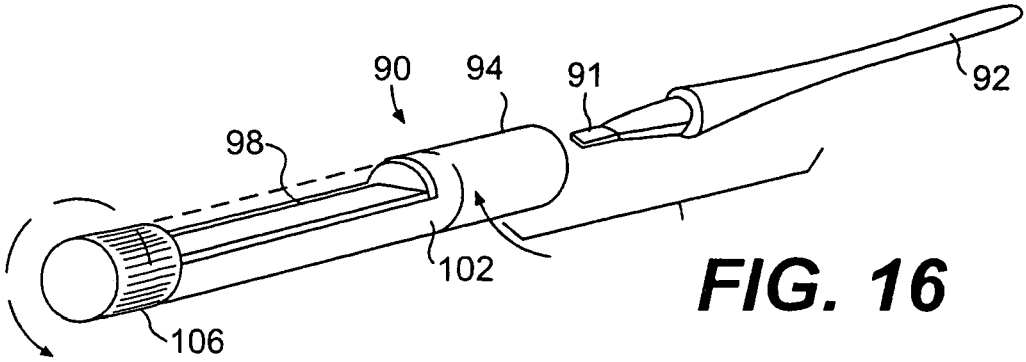
FIG. 16 is an exploded perspective view of yet another embodiment of the invention.
Figure 17:
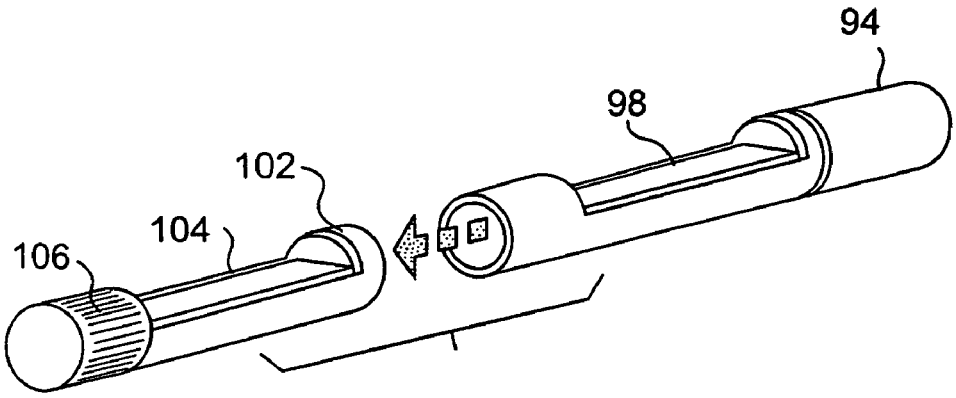
FIG. 17 is an exploded perspective view of the housing member and closing means of the embodiment of FIG. 16.
Figure 18:
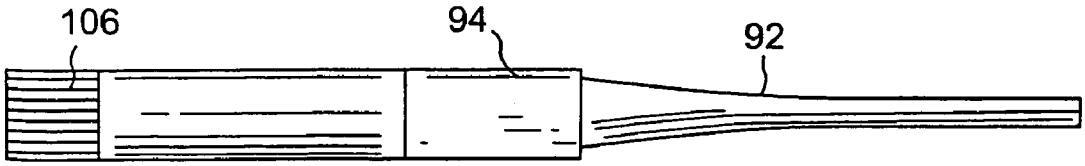
FIG. 18 is a side elevational view of the embodiment of FIG. 16.
Figure 19:
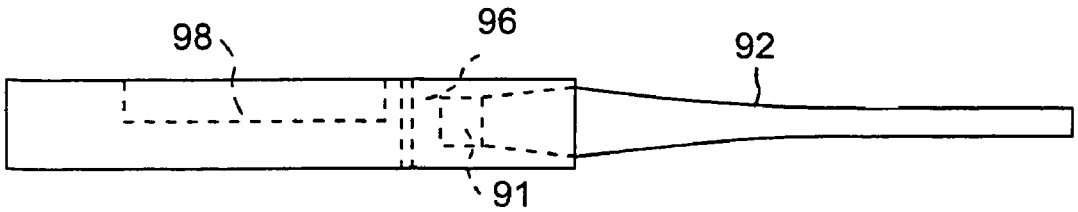
FIG. 19 is a view similar to FIG. 18 but showing the interior of the dispenser in phantom outline.
Figure 25:
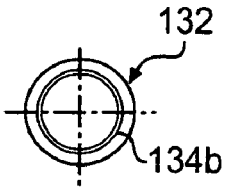
FIG. 25 is a distal end view of the same housing member.

In the further modified embodiment of FIGS. 12–15, the lip colorant dispenser 70 includes a brush 71 mounted in a handle 72, and an elongate cylindrical housing member 74 having, at one end, a well 76 into which the brush may be securely but removably inserted as shown in FIG. 14 so as to be shielded from the air between applications. The receptacle for cosmetic material in this embodiment of the invention is a recess or reservoir 78 formed in, and opening laterally through a side of, the housing member 74 distally of the well 76. To constitute a complete package of cosmetic material, e.g. for retail sale, this reservoir is filled with a coherent body 79 of lip colorant material.

A cover 82, curved to conform to the cylindrical surface of the housing member, overlies the opening of the reservoir 78 and is hingedly connected to the housing member so as to pivot, about an axis parallel to the long dimension of the housing member, between an open position (FIGS. 13 and 15) in which the contents of the reservoir are accessible for pick-up by the brush and a closed position (FIG. 12) in which the cover encloses and protects the reservoir contents from exposure to the air. The cover, which thus serves as the closing means of the dispenser in this embodiment of the invention, is manually openable and closable, with a suitably formed and e.g. conventional latch for releasably retaining it in the closed position.

The cover may be opaque or, as mentioned above, may be transparent to enable viewing of the contents. Additionally or alternatively, a portion of the dispenser exterior (for example, the proximal tip 84 of the brush handle) may be color-coded to identify the contained cosmetic product.

The lip colorant dispenser 90 of FIGS. 16–19 likewise includes a brush 91 with handle 92, an elongate cylindrical housing member 94 having a well 96 at one end to receive the brush for shielding the brush from exposure to air between applications, and a receptacle comprising a reservoir 98 formed integrally within the housing member distally of the well and opening laterally through the cylindrical side wall of the housing member.

In the embodiment of FIGS. 16–19, the closing means is a generally cylindrical cover member 102 which snugly and concentrically surrounds the portion of cylindrical housing member 94 containing the reservoir 98. This cover member (which, like the other elements of the various embodiments of the invention herein described, is conveniently a substantially rigid molded plastic member, and may be either transparent or opaque) is formed with a lateral opening 104 positioned and dimensioned for register with the reservoir 98 to enable access to the contents thereof, and is suitably mounted so as to be manually rotatable about the geometrical axis of housing member 94 while being restrained against axial movement relative to the housing member. The cover member may have a knurled distal end 106 to facilitate manual rotation of the cover member relative to the housing member between positions in which the opening 104 is in and entirely out of register with the reservoir 98. When the opening is entirely out of register with the reservoir, the cover member overlies and closes the reservoir to shield the contents of the reservoir from exposure to air.

Currently preferred embodiments of the invention, in which the opening and closing of the receptacle can be actuated by manually turning the applicator unit (e.g., incident to insertion or removal of the applicator into the well of the container unit), are illustrated in FIGS. 20–38. Referring first to FIGS. 20–31, the embodiment there shown is a dispenser 110 constituted of a manipulable applicator unit 111 and a container unit 112. The applicator unit includes a stem 114 having a generally cylindrical central portion 116, a hollow and open-ended cylindrical distal portion 118 of smaller diameter for holding the bristles of a brush 120, and a proximal head portion 122 to which is permanently mounted a handle or cap 124 to be grasped by the user. The bristles of the brush are flexible synthetic fibers, generally parallel to each other, with free distal ends 126 and with their proximal portions inserted in the stem portion 118, in which they are anchored by glue at zone 128.

The stem and the cap 124 are molded plastic elements. As best seen in FIG. 21, a pair of short, transversely projecting nibs 130 are disposed 180° apart on the stem portion 116, being molded integrally with the stem.

It will be understood that, while the nibs 130 of the applicator unit 110 are shown as exposed in FIG. 20, the cap 124 of the applicator unit may include a distal skirt portion laterally surrounding and covering the region of the nibs in outwardly spaced relation thereto. The skirt portion, in such a modification, overlies the proximal end portion of the base cap when the applicator unit is seated on the container unit.

The container unit includes an elongated, axially rectilinear and substantially rigid outer housing member or base cap 132, also a unitary molded plastic element, having a generally cylindrical hollow interior 134 extending from the proximal end 134*a* to the distal end 134*b* thereof, and open at both ends. Within this interior 134 is disposed an inner member or insert 136, extending from end to end of the base cap, substantially coaxially therewith, and dimensioned to fit snugly in the base cap but to be easily rotatable about the long common axis of the base cap and inner member. A transverse septum 138 divides the inner member into a proximal portion forming a well 140 opening endwise through the proximal extremity of member 136, and a distal portion forming a receptacle or pocket 142 having an open side 144. The distal end 146 of the inner member 136 is closed and provided with an externally accessible, transverse tab 148. The entire inner member may be an integral molded plastic element, but it is thinner-walled and somewhat more flexible than the rigid base cap 132. An aluminum pan 150, containing a coherent body (not shown) of cosmetic material such as lip colorant, is stably seated in the pocket 142, with the exposed surface of the cosmetic material facing the open side of the pocket so as to be accessible to the exterior when the pocket or receptacle is open.

An axially elongated lateral opening or window 152 is formed in the distal portion of the base cap 132, in position for register with the open side of the receptacle or pocket 142 when the inner member is rotated within the base cap to a first angular position. At a second angular position of the inner member relative to the base cap (e.g. about 90° to about 180° from the first position), the window 152 is entirely out of register with the open side of the pocket and is completely occluded by a continuous closed pocket-defining side wall of the inner member. That is to say, when the inner member is in the second angular position, a solid wall portion of the base cap overlies and completely closes the open side of the pocket, fully enclosing and thus shielding the contained cosmetic material. Stated more broadly, the angle of rotary displacement between fully open and fully closed positions may be designed to be any selected value within a range of about 30° to about 330°. In one currently preferred embodiment, this angle is 135°.

Figure 26:
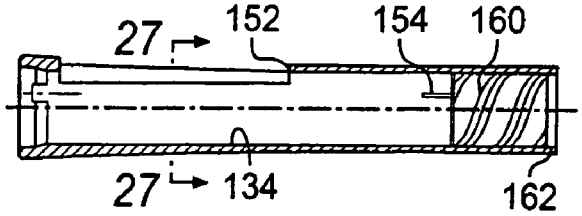
FIG. 26 is a side elevational sectional view of the same housing member.
Figure 29:
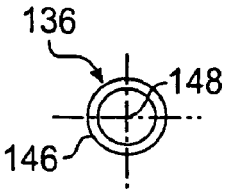
FIG. 29 is a distal end view of the same inner member.
Figure 28:
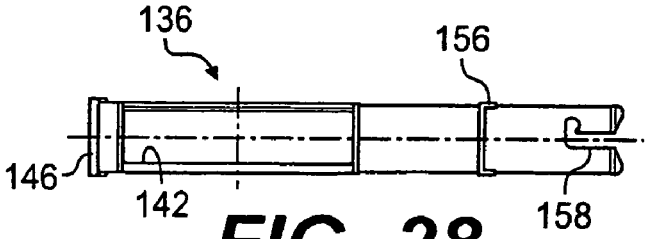
FIG. 28 is a plan view of the inner member of the embodiment of FIG. 20.
Figure 31:
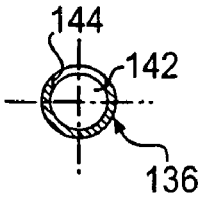
FIG. 31 is a cross-sectional view taken along line 31—31 of FIG. 26.
Figure 30:
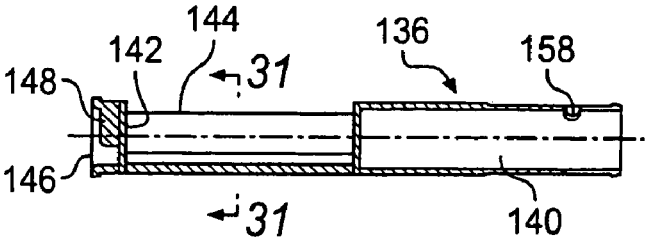
FIG. 30 is a side elevational sectional view of the same inner member.
Figure 32:
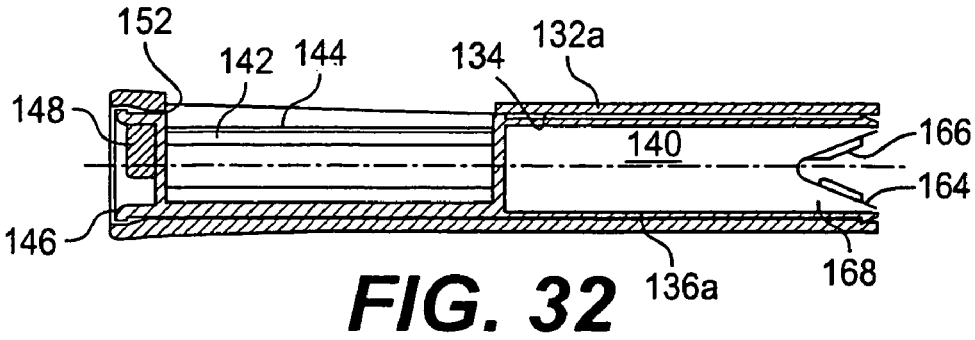
FIG. 32 is a side elevational sectional view of the container unit of a further modified embodiment of the invention, in which the applicator unit (not shown) may be identical to that of FIG. 20.
Figure 33:
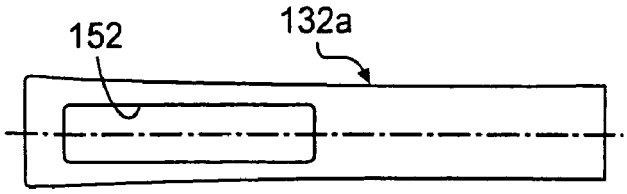
FIG. 33 is a plan view of the housing member of the embodiment of FIG. 32.
Figure 34:
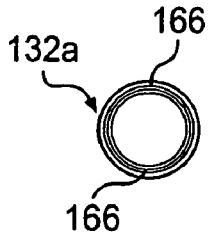
FIG. 34 is a proximal end view of the same housing member.
Figure 35:
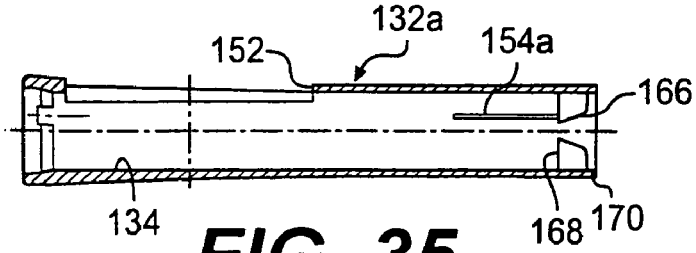
FIG. 35 is a side elevational sectional view of the same housing member.
Figure 36:
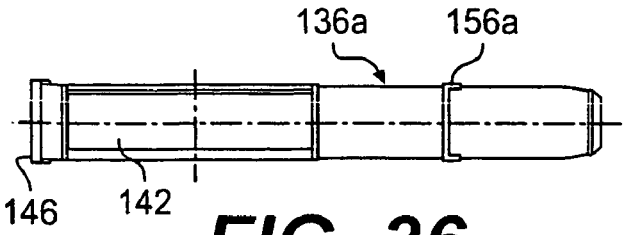
FIG. 36 is a plan view of the inner member of the embodiment of FIG. 20.
Figure 37:
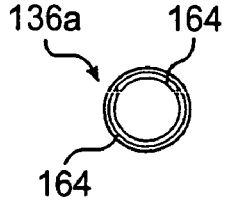
FIG. 37 is a proximal end view of the same inner member.
Figure 38:
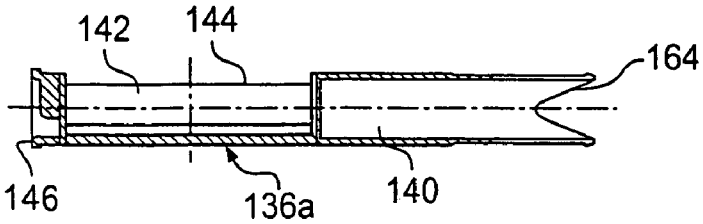
FIG. 38 is a side elevational sectional view of the same inner member.
Figure 39:
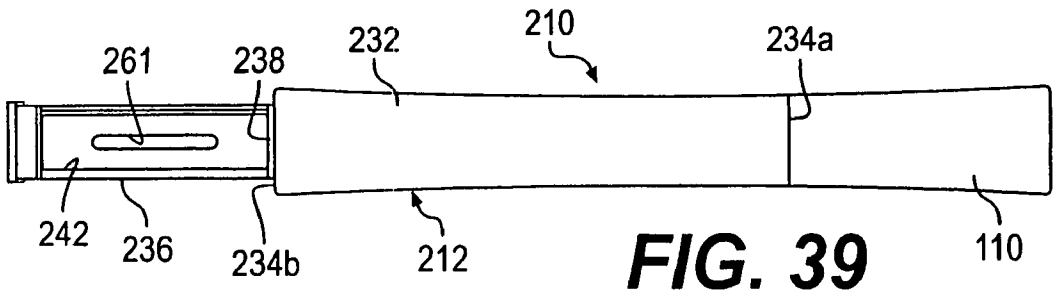
FIG. 39 is a side elevational view of another dispenser embodying the invention, in which the applicator unit may again be identical to that of FIG. 20.
Figure 40:
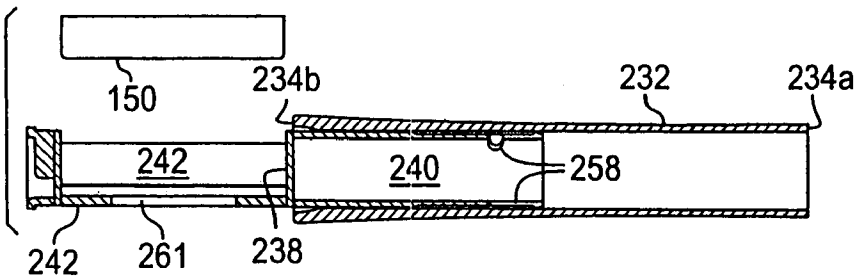
FIG. 40 is a partially exploded side elevational sectional view of the container unit of the dispenser of FIG. 39, with the inner member or drawer in extended (open) position.
Figure 41:
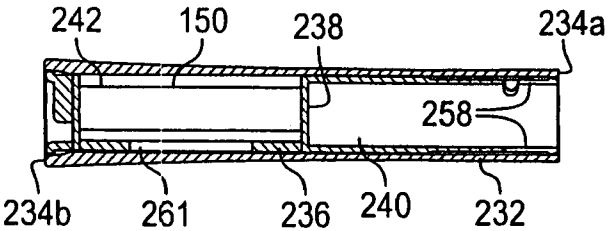
FIG. 41 is a side elevational view of the same container unit, with the inner member in retracted (closed) position.
Figure 42:
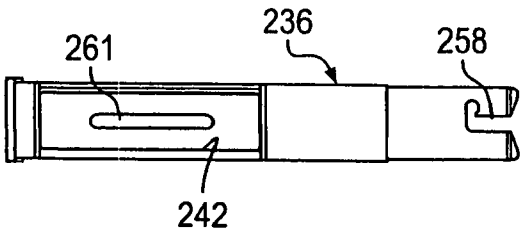
FIG. 42 is a plan view of the inner member of the container unit of FIGS. 39–41.
Figure 43:
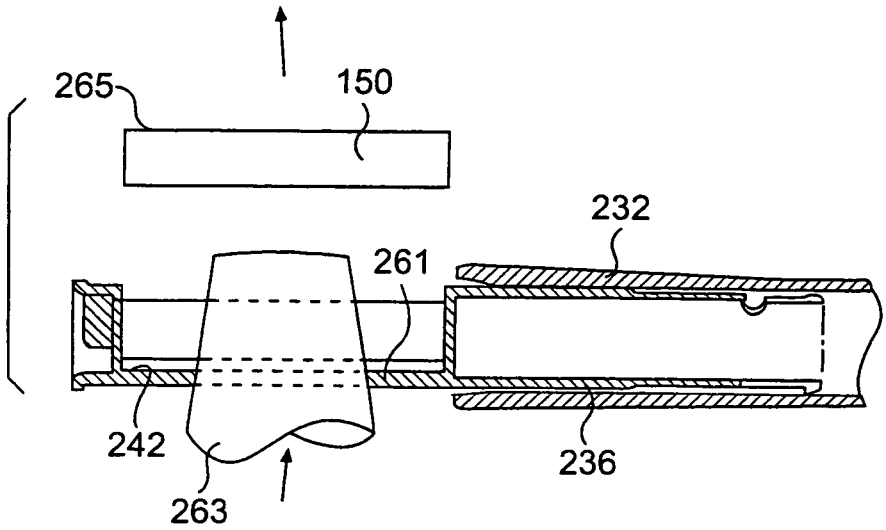
FIG. 43 is a view similar to FIG. 40, illustrating the removal of the pan that holds the coherent body of cosmetic or other material.

As seen in FIGS. 26 and 28, cooperating stop projections 154 and 156 may be respectively formed on the interior wall of the base cap and the outer wall of the insert 136 to engage each other for limiting the extent of rotation of the insert, relative to the base cap, to the aforementioned first and second angular positions. This effectively locks the receptacle or pocket at either of the two positions, at which the pocket is respectively open and closed, as selected by the user.

More particularly, the respective stop projections 154 and 156 of the base cap and the insert interengage with a sensible click to releasably lock the inner member relative to the housing member at each of the two extremities of rotary position. The user can feel and/or hear the click, being thereby assured that the desired locked position has been attained. As shown, the projection 154 is an axially oriented rib, and the projections 156 constitute two pairs of short, parallel, axially oriented ribs respectively positioned to snap or click into locking engagement with projection 154 at the locations at which the pocket is fully open and fully closed, i.e., completely in and completely out of register with the window 152.

Figure 24:
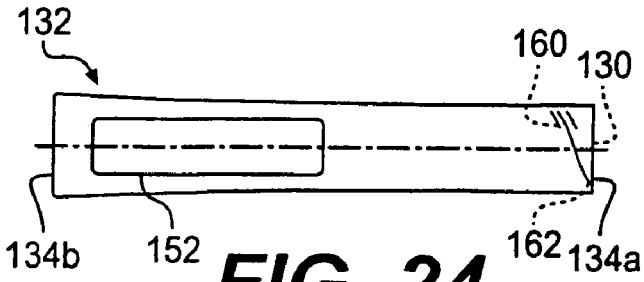
FIG. 24 is a plan view of the housing member of the embodiment of FIG. 20.
Figure 27:
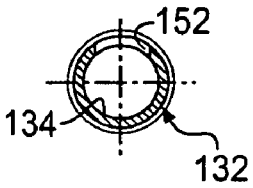
FIG. 27 is a cross-sectional view taken along line 27—27 of FIG. 26.

In the embodiment of FIGS. 20–31, the proximal extremity of the insert 136 is formed with a pair of L-shaped notches or slots 158, 180° apart, for respectively receiving the two nibs 130 of the applicator stem when the applicator is inserted in the well 140. The inner wall of the hollow interior of the base cap, adjacent the proximal end thereof, has a helical groove or thread 160 also arranged to receive the nibs of the applicator unit. This thread is offset slightly inwardly from the proximal rim of the base cap as indicated at 162 in FIGS. 24 and 26. FIG. 24 indicates, in phantom outline, the position of a nib 130 entering the thread 160.

The nibs are so dimensioned that, when the applicator stem is inserted into the well 140 (coaxially with the base cap) brush end first, the nibs 130 enter and engage the slots 158 of the inner member 136 and project transversely outwardly beyond the wall of the inner member so as to enter the thread 160. Consequently, the user must rotate the applicator unit to insert it threadingly into the proximal end of the container unit, and this rotation serves to rotate the inner member 136, turning the pocket 142 from open to closed position relative to the window 142. The threaded engagement of the nibs with the helical groove seats the applicator securely in the proximal end of the base cap, with the brush shielded by the well.

As the applicator is rotated in reverse to remove it from the well, reverse rotation is imparted by the nibs to the inner member 136 to rotate the pocket 142 back to the open position so that the contained cosmetic material is exposed for access and pickup. Thus, threaded insertion and withdrawal of the applicator result in concomitant and effectively automatic closing and opening of the receptacle holding the cosmetic material. As hereinafter explained, in the described embodiment there are alternative ways of opening and closing the receptacle without seating the applicator in the well.

The hollow interior of the base cap flares at the distal end, and is somewhat constricted at the beginning of the thread 160 just inwardly of the proximal end, of the container unit. Outwardly projecting annular flanges formed on the exterior of the inner member 136 interfere with these features of the base cap to prevent axial dislodgment of the inner member from the base cap, although the flexibility of the inner member is sufficient to enable its initial insertion in the base cap.

The embodiment of FIGS. 32–38 differs from that of FIGS. 20–31 only with respect to the structures of the proximal ends of the base cap and inner member that engage the applicator stem, and the consequent cooperation of these elements with the applicator in rotating the pocket between open and closed positions and in retaining the inserted applicator in the well. The applicator unit in this embodiment, including the stem and nibs, may be identical to that shown in FIGS. 20 and 21 and described above. The base cap 132*a* and the inner member 136*a* of the embodiment of FIGS. 32–38 may likewise be identical to the corresponding elements 132 and 136 of the embodiment of FIGS. 20–31 except adjacent their proximal ends; i.e., the structure and arrangement of hollow interior 134, well 140, pocket 142 with open side 144, distal end 146 with tab 148, and window 152 may be as described with reference to FIGS. 20–31.

In place of the L-shaped slots of FIGS. 20–31, however, the inner member 132*a* of FIGS. 32–38 has a pair of diametrically opposed, distally tapering notches 164 formed in its peripheral extremity, into which the nibs 130 are introduced as the applicator is inserted into the well. A pair of axially extending, distally tapering grooves 166 are formed, also 180° apart, at the proximal end 134*a* of the hollow interior wall of the base cap 132, leading to an annular ledge 168 within the interior of the proximal portion of the base cap. The entry ends of these grooves are offset inwardly from the proximal end of the base cap as indicated at 170. When the pocket 142 has its open side 144 in register with the window 152 of the base cap 132*a*, the notches 164 are in register with the grooves 166. The applicator is inserted into the well 140 with the nibs 130 respectively oriented to enter these aligned notches and grooves, the nibs being dimensioned to project outwardly beyond the notches and into the grooves. The applicator is inserted to its maximum depth in well 140 by straight axially directed movement, with no turning, guided by the notches and grooves. As it reaches the maximum depth, the nibs pass inwardly of (distally beyond) annular ledge 168, enabling the applicator to rotate. Such rotation, by engagement of the nibs with the edges of the notches 164, rotates the inner member 136*a* to turn the pocket to the closed position, at which its open side is entirely out of register with the window 152 and the wall of base cap 132*a* completely covers the open side of the pocket. Such rotation also turns the nibs out of register with the grooves so that the ledge 168, engaging the nibs, holds the applicator against removal from the well until it is rotated back into a position at which the nibs are in register with the grooves, again opening the pocket; the applicator may then be pulled straight out of the proximal end of the base cap to free it for use.

The structure and operation of the two embodiments of the invention respectively shown in FIGS. 20–31 and 32–38 may be further elucidated by the following comparative description:

The two dispensers are similar to each other in that both have a stem 114 that is used to close a window 152; the window covers a pocket 142, or pan 150, which contains the cosmetic product; and the stem and cap 124 may be the same for both. The differences are in the base cap 132, 132*a* and base insert (inner member 136, 136*a*).

The embodiment of FIGS. 20–31 has a helical groove 160 (hence, it may be termed the threaded version), but that of FIGS. 32–38 (termed the straight-pull version) does not. Removing the helical groove changes the kinematics of the package; the closure action is different.

In the threaded version, the two actions (insertion and removal of the applicator, and closing and opening of the pocket) are linked (actions are kinematically dependent), and in the straight-pull version, the two actions are separate (kinematically independent).

In the threaded version, the stem travels axially at the same time that it rotates until it is fully inserted in the locked rotational position (the window closes along with it). The nibs 130 on the stem travel in a spiral, along the helical grooves (thread 160) on the base cap. The nibs also travel along the slots 158 of the base insert 136.

In open position, the pocket open side 144 in the base insert is aligned with the window 152 on the base cap and the stem and cap assembly 111 are separate from the base cap and base insert assembly 112. As the stem is inserted into the base cap, the helix forces the stem to rotate. As the stem rotates, it forces the pocket in the base insert to rotate away from alignment with the window on the base insert, thereby closing the window. There is a locking mechanism at both the start and end of the rotation to lock the pocket into both the open and closed positions.

In the straight-pull version, the stem 114 is first fully inserted in the well 140, and then, the stem is rotated into the locked position (the window does not start to close until the stem rotates). The nibs 130 on the stem travel axially, along the tapered grooves 166 in the base cap 132*a*. Once the nibs pass the far end of the groove, the nibs travel rotationally. The nibs also travel along the grooves 164 of the base insert 136*a*.

As the stem is inserted into the base cap, the taper of the grooves forces the nibs into the starting rotational position. When the stem is fully inserted, it is limited to rotational movement. As the stem rotates, it forces the pocket 142 in the base insert 136*a* to rotate away from alignment with the window 152 on the base insert. The pocket open side 144 rotates from open, locked position to closed, locked position.

In both embodiments, the stem 114 is the driving force that closes and opens the window (i.e., moves the open side 144 of pocket 142 out of and back into register with window 152 of base cap 132 or 132*a*), by rotating the base insert 136 or 136*a*. However, in both versions, the window can be closed without the use of the stem, or without fully inserting the stem.

The window can be in the closed position while the applicator unit 111, including stem 114, remains unassembled with the container unit 112. The tab 148 at the distal end 146 of the base insert 136 or 136*a* can be used to rotate the insert and thus open and close the window, without using the stem. The stem nibs 130 can also ride along a recess at the open proximal end of the base cap, such recess being indicated at 162 in FIG. 24 and at 170 in FIG. 35 as described above, engaging and rotating the base insert 136 or 136*a* to close the window, yet remain separate from the container unit assembly.

Moreover, the nibs 130 are shallow enough and flexible enough to jump the threaded grooves. Thus, the stem 114 can be inserted into the well 140 after the window is in closed position.

The straight pull version (FIGS. 32–38) permits addition of more features to the locking mechanism, if desired (see locking lug 154*a* on the base cap drawing of the straight-pull version). The straight pull version also permits provision of a locking mechanism that directly links the base cap to the stem, whereas, in the threaded version, the locking mechanism acts indirectly on the stem; i.e., the base cap prevents the base insert from turning, which stops the stem. That is to say, in addition to the locking engagement between lugs or ribs 156*a* on the insert and lug or rib 154*a* on the inner wall of the base cap (described above with reference to the embodiment of FIGS. 20–31), the rib 154*a* may be extended in the proximal direction to engage, and serve as a stop for, the nibs 130.

Three further illustrative embodiments of the invention are respectively shown in FIGS. 39–43, 47–48C, and 49. In each of these embodiments, the opening and/or closing and locking of the receptacle or pocket (in which the cosmetic or other material to be applied is contained) is effected by manipulation of the applicator unit, but the receptacle does not rotate relative to an enclosing sheath or sleeve; instead, opening and closing is effected by axially directed translational movement. It is sometimes desired that the receptacle be refillable with the material (e.g. cosmetic) to be applied so that the consumer does not need to buy a complete dispenser device each time the supply of material in the receptacle is exhausted; arrangements for providing refills are specifically described with reference to the fist of the following embodiments.

FIGS. 39–42 show a dispenser 210 embodying the invention and incorporating an applicator unit 110 which may be structurally identical to that already described with reference to FIG. 20, including stem 114, brush 120, cap 124 and nibs 130 all as shown in FIG. 20. The dispenser 210 also includes a container unit 212 having a hollow open-ended base cap 232 with a proximal end 234*a* and a distal end 234*b*. An inner member or insert 236, dimensioned to be received within and to extend from end to end of the base cap, is divided transversely by septum 238 into a well 240 opening through the proximal end of the insert, and a pocket 242 opening laterally through a side (top) of the distal portion of the insert. The well 240 and pocket 242 may respectively correspond, both structurally and functionally, to the well 140 and pocket 142 of insert 136 of FIG. 20; thus, the pocket 242 receives an aluminum pan 150 holding a coherent body of material (such as lip colorant), while the well 240 serves to receive and shield the applicator.

In the embodiment of FIGS. 39–42, however (unlike that of FIG. 20), the base cap is not provided with a laterally opening window, and the insert 236 does not rotate within the base cap but instead slides longitudinally (axially) into and out of the distal end of the base cap, in a manner similar to the drawer-type receptacles of the embodiments of FIGS. 1–8 described above. That is to say, the base cap constitutes the cover for the receptacle, which is opened by moving the insert form the retracted position of FIG. 41 to the extended position of FIG. 40.

On the other hand, in common with the embodiment of FIG. 20, the insert 236 is formed at its proximal end with a pair of L-shaped notches 258 (similar to the notches 158 of FIG. 28) 180° apart for respectively receiving the nibs 130 of the applicator unit stem. When the insert 236 is in the retracted position and the applicator 110 (see FIG. 20) is placed into the well, the nibs enter and advance along the notches 258 until they reach the distal ends of the notches. The applicator unit is then rotated to move the nibs into a locking position at the inner extremity of the L-shaped notches. In this position, the nibs lock and retain the insert 236 in the retracted position. By rotating the applicator unit in the opposite direction and pulling it out of the well, the insert 236 is released so as to be movable to open position.

As an additional feature of advantage, the pan 150 can be removable from the pocket 242 to enable replacement of an empty pan with a fresh pan 150 filled with the cosmetic or other material to be dispensed, i.e., a refill pan. To this end, a slot 261 is formed in the bottom of the pocket, to enable a suitable ejector tool 263 (FIG. 43) to be inserted for forcing the pan 150 up and out of the pocket. Any appropriately dimensioned rigid blade or fin can serve as the ejector tool.

Figure 44C:
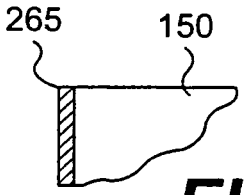
FIGS. 44A, 44B and 44C are, respectively, a plan view, a cross-sectional view, and an enlarged fragmentary end corner view of the pan of FIG. 43.
Figure 44A:
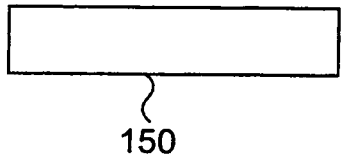
Figure 44B:
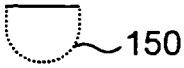

The pan 150 itself (FIGS. 44–44C) is an elongated rectangular shell, open at the top, fabricated of aluminum and dimensioned to fit snugly within the pocket 242. The top end edges of the pan may be formed with small projecting burrs 265 to engage the plastic material of the end walls of the pocket and thereby to anchor the pan in the pocket, yet to permit ejection of the pan by means of the tool 263 for refilling the dispenser.

Figure 45A:
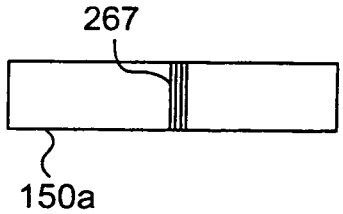
FIGS. 45A and 45B are, respectively, a plan view and a side elevational sectional view of a pan with two compartments.
Figure 46B:
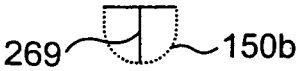
FIGS. 46A and 46B are, respectively, a perspective view and a cross-sectional view of a pan with three compartments.
Figure 45B:
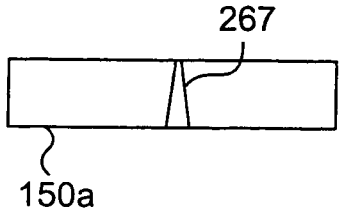
Figure 46A:
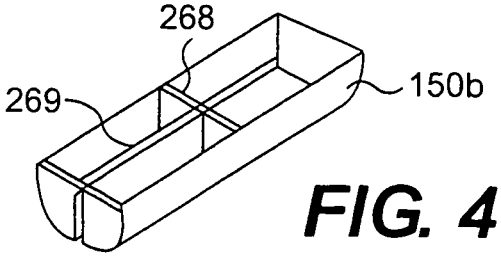

If desired, a pan 150*a* (FIGS. 45A and 45B) may be divided into two compartments by a partition 267, e.g. for holding two different cosmetic materials to be applied. The pan may be further divided into additional compartments; FIGS. 46A and 46B illustrate a pan 150*b* divided into three compartments by transverse partition 268 and longitudinal partition 269.

Figure 47:
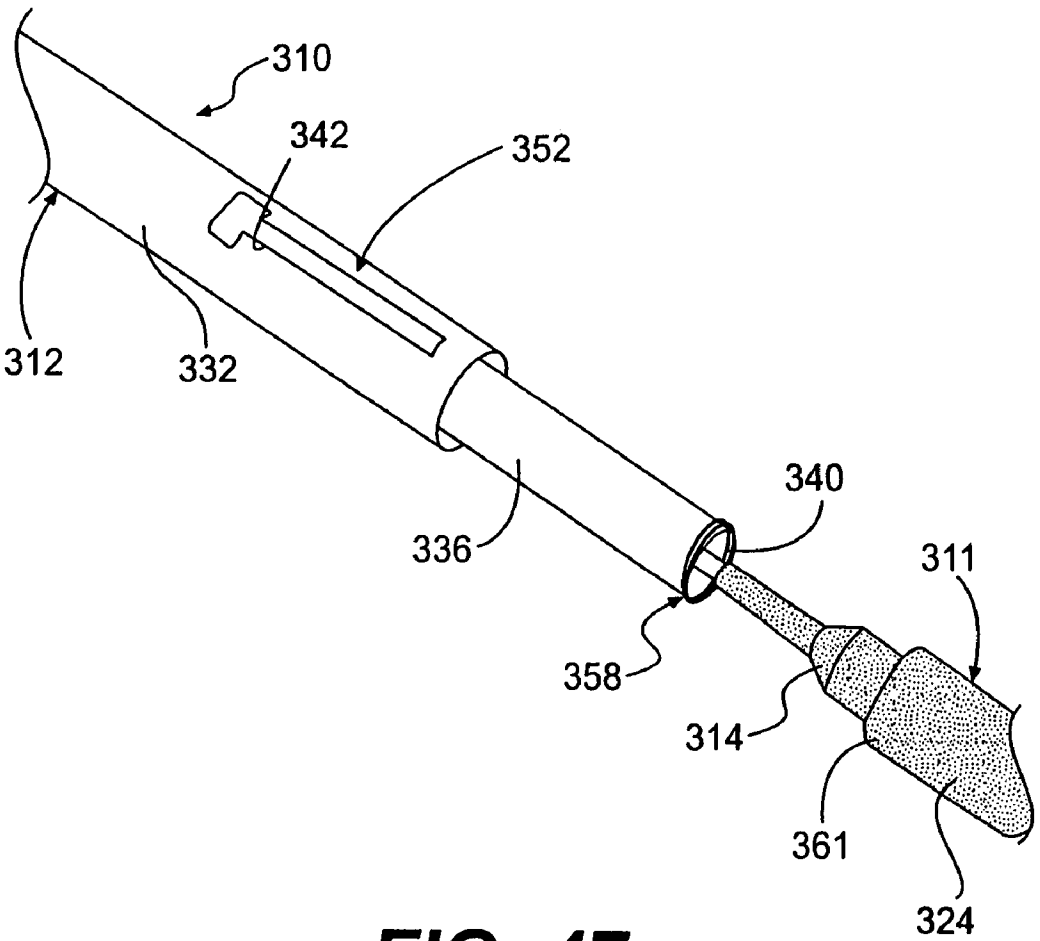
FIG. 47 is a fragmentary perspective view of a further dispenser embodying the invention.
Figure 48A:
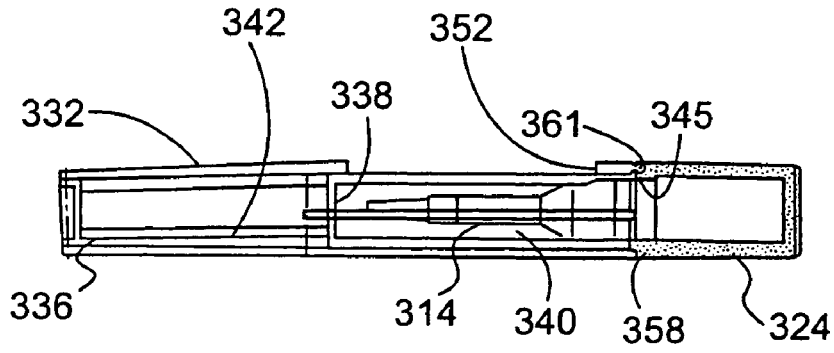
FIGS. 48A, 48B and 48C are side elevational sectional views of the dispenser of FIG. 47 respectively showing successive steps in removing the applicator and opening the container unit.
Figure 48B:
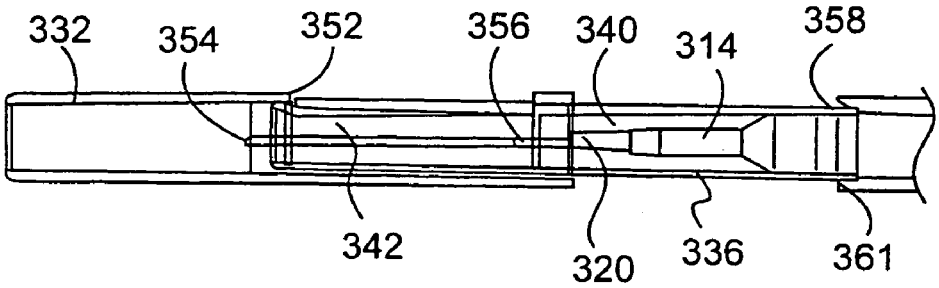
Figure 48C:
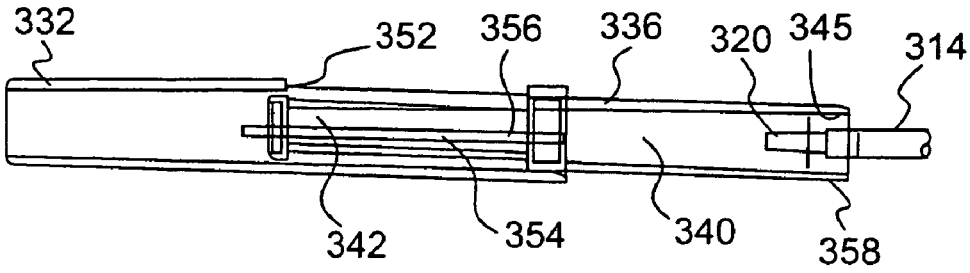

A still further embodiment of the invention is shown in FIGS. 47–48C. The dispenser 310 of this embodiment includes an applicator unit 311 and a container unit 312. The applicator unit has a central stem 314 bearing, at its distal end, an applicator 320, and secured at its proximal end to an applicator cap 324. The container unit includes an elongated, hollow, cylindrical base cap 332 open at its proximal end, and an inner member 336 of generally cylindrical configuration, insertable within and substantially coextensive in length with the base cap. It should be noted that the base cap, in this and other embodiments (such as, without limitation, those of FIGS. 20 and 39), does not necessarily have to be the same length as the base insert; the base cap need only be long enough to cover the full length of the lateral opening of the pocket and thus may, for example, be only about half the length of the base insert.

In the embodiment of FIGS. 47–48C, the base cap and inner member correspond respectively to the base cap and inner member or insert of the embodiment of FIGS. 39–42. The inner member 336 is divided by a transverse septum 338 into a well 340 opening through the proximal end of the inner member, and a laterally opening receptacle or pocket 342 in the distal portion of the inner member for holding a coherent body of material to be applied.

The inner member 336 is slidable axially relative to the base cap 332 through the open proximal end 334*a* of the base cap, between a fully inserted or closed position (FIG. 48A) in which only a short proximal end portion 345 of the inner member projects outwardly beyond the base cap, and an open position (FIGS. 47, 48B and 48C) in which the pocket 342 is disposed within the proximal portion of the base cap. A laterally opening window 352 is formed in the side wall of the proximal portion of the base cap for register with the open side of the pocket 342 when the inner member 336 is in the latter, open position, thereby to provide external access to the material contained within the pocket.

Longitudinal grooves 354 are formed 180° apart in the inner wall of the base cap, for receiving nibs or lugs 356 formed 180° apart on the outer wall of the inner member 336. The insertion of the lugs in the grooves 354 prevents rotation of the inner member relative to the base cap; in addition, the grooves terminate within the base cap at locations selected to serve as stops for engaging the lugs to arrest the longitudinal travel of the inner member at fully retracted and fully extended positions. The material of the inner member is sufficiently flexible to permit insertion of the inner member into the base cap until the lugs seat in the grooves, during initial assembly of the dispenser.

The proximal end 345 of the inner member 336 bears an external thread 358. The cap 324 of the applicator unit terminates distally in an internally threaded skirt 361 concentrically surrounding the stem 314 in spaced relation thereto. The internal thread of applicator cap skirt 361 engages the external thread 358 of inner member 336 when the dispenser is fully assembled and closed as shown in FIG. 48A.

In closed condition, the pocket 342 is disposed within and enclosed by the side wall of the distal portion of the base cap 332, which thus serves as a cover to shield the contents of the pocket. The applicator is disposed within and shielded by the well 340, being stably held therein by the threaded engagement of the applicator cap with the inner member.

To open the dispenser, the applicator is pulled manually away from the base cap, drawing the inner member 336 with it (because of the aforesaid threaded engagement) until the open side of the pocket comes into register with the window 352 to expose the material contained in the pocket. The applicator cap is then unscrewed from the inner member to detach the applicator for use; the pocket remains in alignment with the window, since the inner member is held against rotation by the lugs 356 and grooves 354.

Figure 49:
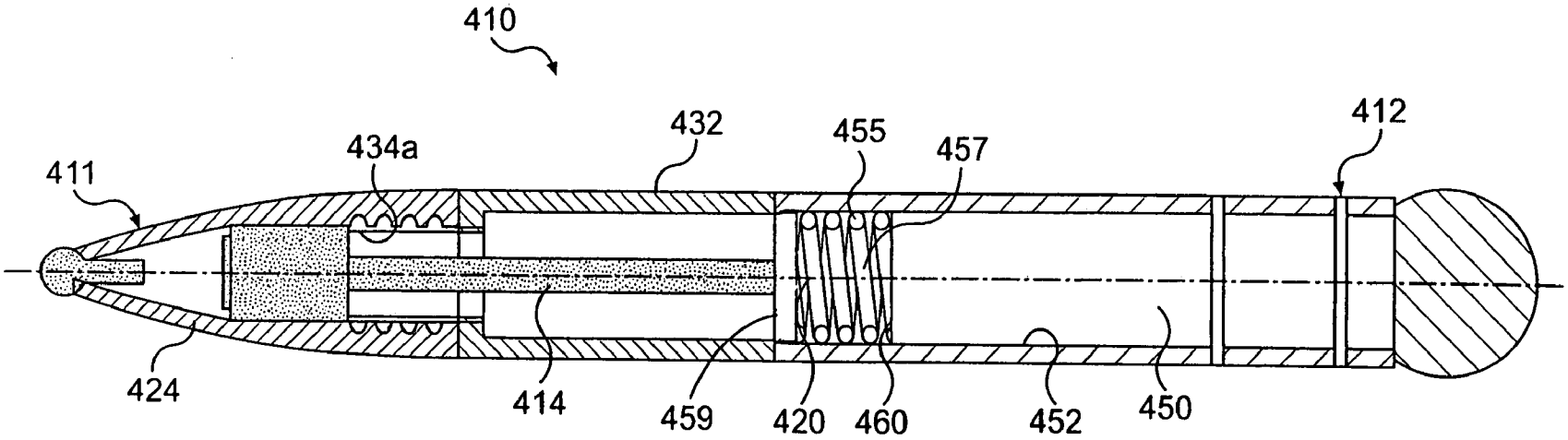
FIG. 49 is a somewhat schematic side elevational sectional view of yet another embodiment of the invention.

The dispenser 410 of FIG. 49 has an applicator unit 411 and a container unit 412. The unit includes a stem 414 bearing an applicator 420 and secured proximally to an internally threaded cap 424, while the container unit comprises a rigid, hollow outer sleeve 432, open at least at its proximal end 434*a* which is externally threaded for engagement with the applicator cap.

Within the distal portion of the sleeve 432 is mounted a laterally open pan 450 for holding the material to be applied. A laterally opening window 452 in the distal portion of the sleeve 432 provides access to the pan and contents.

Also disposed within the hollow interior or the sleeve 432 is an inner sleeve 455 (e.g. made of aluminum), disposed to slide axially between a distal position in which it covers and closes the window 452, and a proximal position in which it is clear of the window. A helical spring 457, located within the inner sleeve and under compression between the proximal end 459 of the inner sleeve and a transverse bearing face 460 secured to sleeve 432, biases the inner sleeve to the proximal (window open) position.

When the cap is threaded on the outer sleeve, the stem 414 projects within the proximal portion of the interior of the outer sleeve, which serves as a well to shield the applicator. A portion of the stem 414 bears against the proximal end 459 of the inner sleeve 455 (which has a central hole to accommodate the applicator) and pushes the inner sleeve into its distal (window closed) position against the force of the spring 457, thereby shielding the contents of the pan. Upon removal of the cap the inner sleeve is released, and the spring moves it to the window-open position.

Figure 50A:
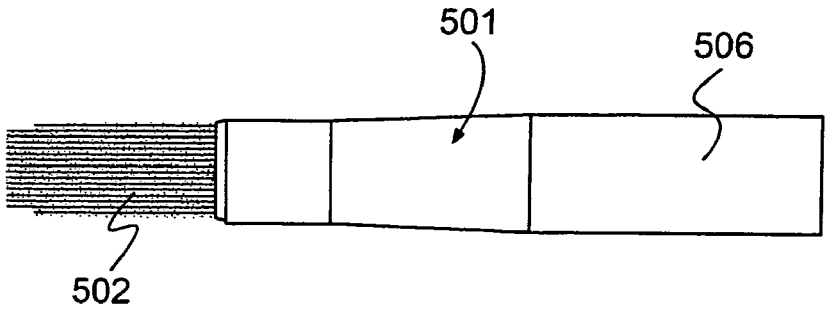
FIGS. 50A, 50B and 50C are, respectively, a plan view, a side elevational sectional view and an end view of one type of brush suitable for use as the applicator in the invention.
Figure 50B:
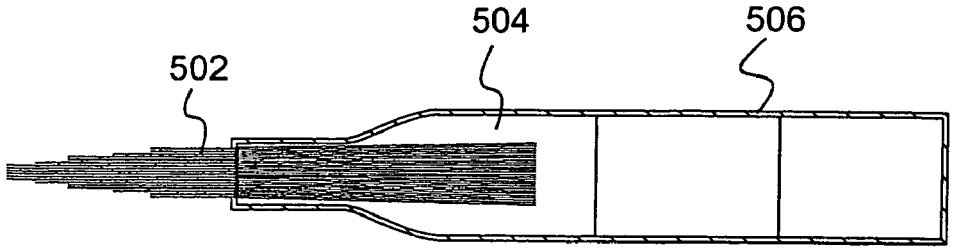
Figure 50C:
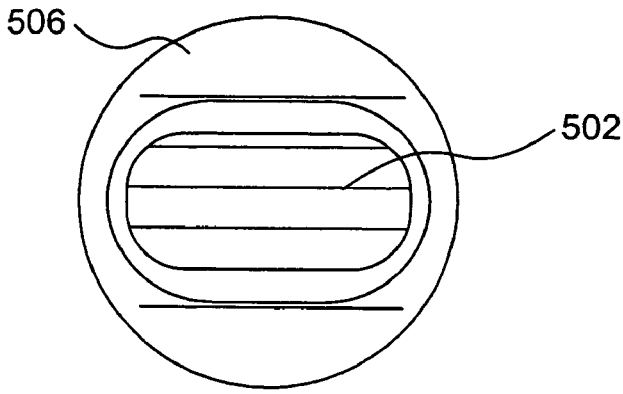
Figure 51:
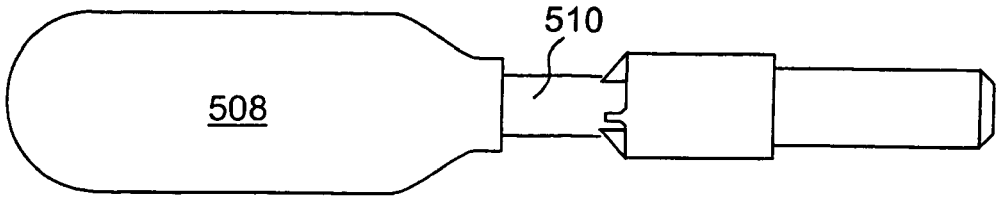
FIG. 51 is a side elevational view of another type of applicator that can be used in dispensers of the invention.
Figure 52A:
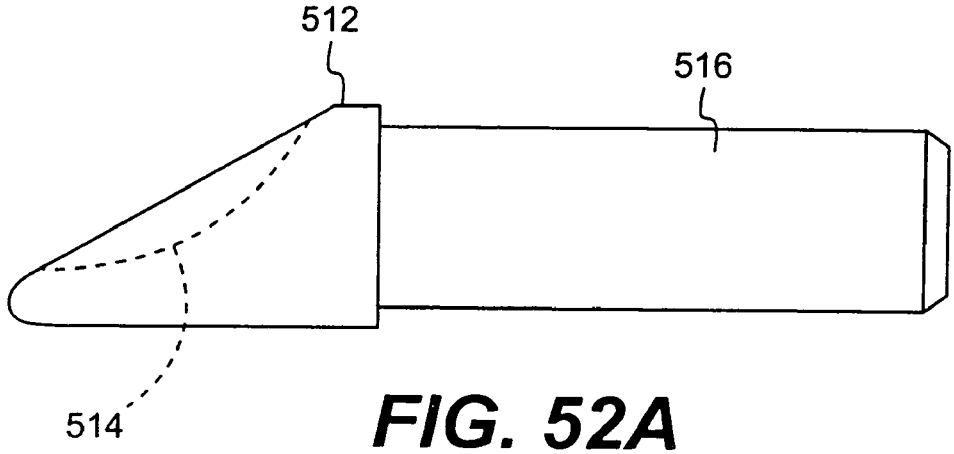
FIGS. 52A, 52B and 52C are, respectively, a side elevational view, a plan view and an end view of a further type of applicator usable in dispensers of the invention.
Figure 52B:
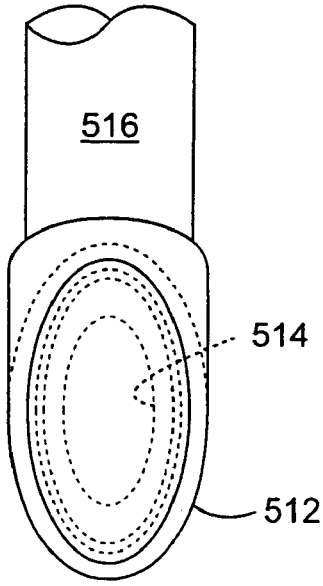
Figure 52C:
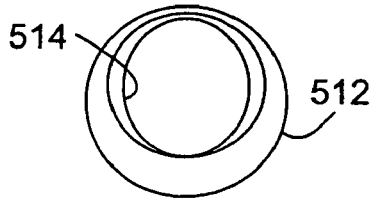
Figure 53A:
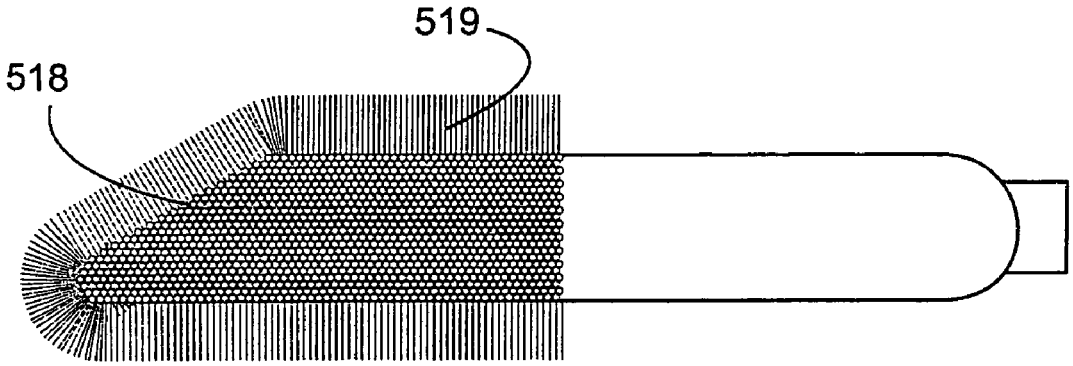
FIGS. 53A and 53B are, respectively, side and end views of yet another type of applicator for use in the invention.
Figure 53B:
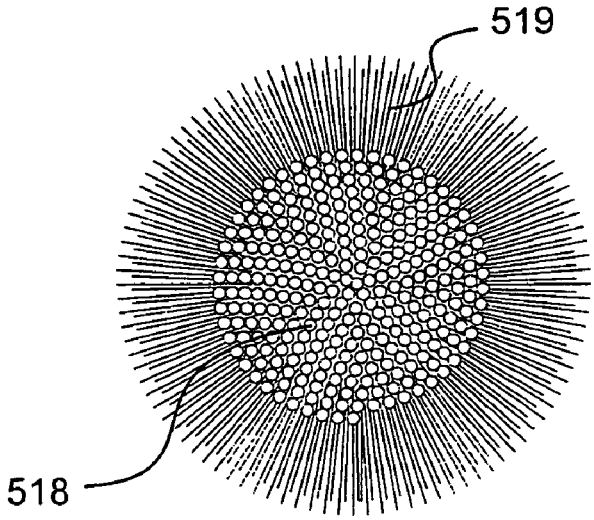

An exemplary but non-limiting selection of types of applicator suitable for inclusion in the dispensers of the invention is shown in FIGS. 50A–53B. Thus, the applicator may be a brush 501, as illustrated in FIGS. 50A–50C, constituted of a parallel array of synthetic fibers 502 held by adhesive 504 in an aluminum sleeve 506, which may be secured to the stem of an applicator unit. Another applicator, shown in FIG. 51, is a body of fine pore, open-cell polyester/ polyurethane sponge 508 mounted on a shaft 510. A third variety, illustrated in FIGS. 52A–52C, includes a molded elastomer tip 512 having a distal end formed with a shallow cup 514, which may be oriented at an oblique angle to the stem 516; this type of applicator is described in copending U.S. provisional patent application No. 60/151,526, filed Aug. 30, 1999. Another applicator suitable for use in the dispensers of the invention, shown in FIGS. 53A–53B, is a deerfoot flexer 518 with nylon flocking 519.

Figure 54:
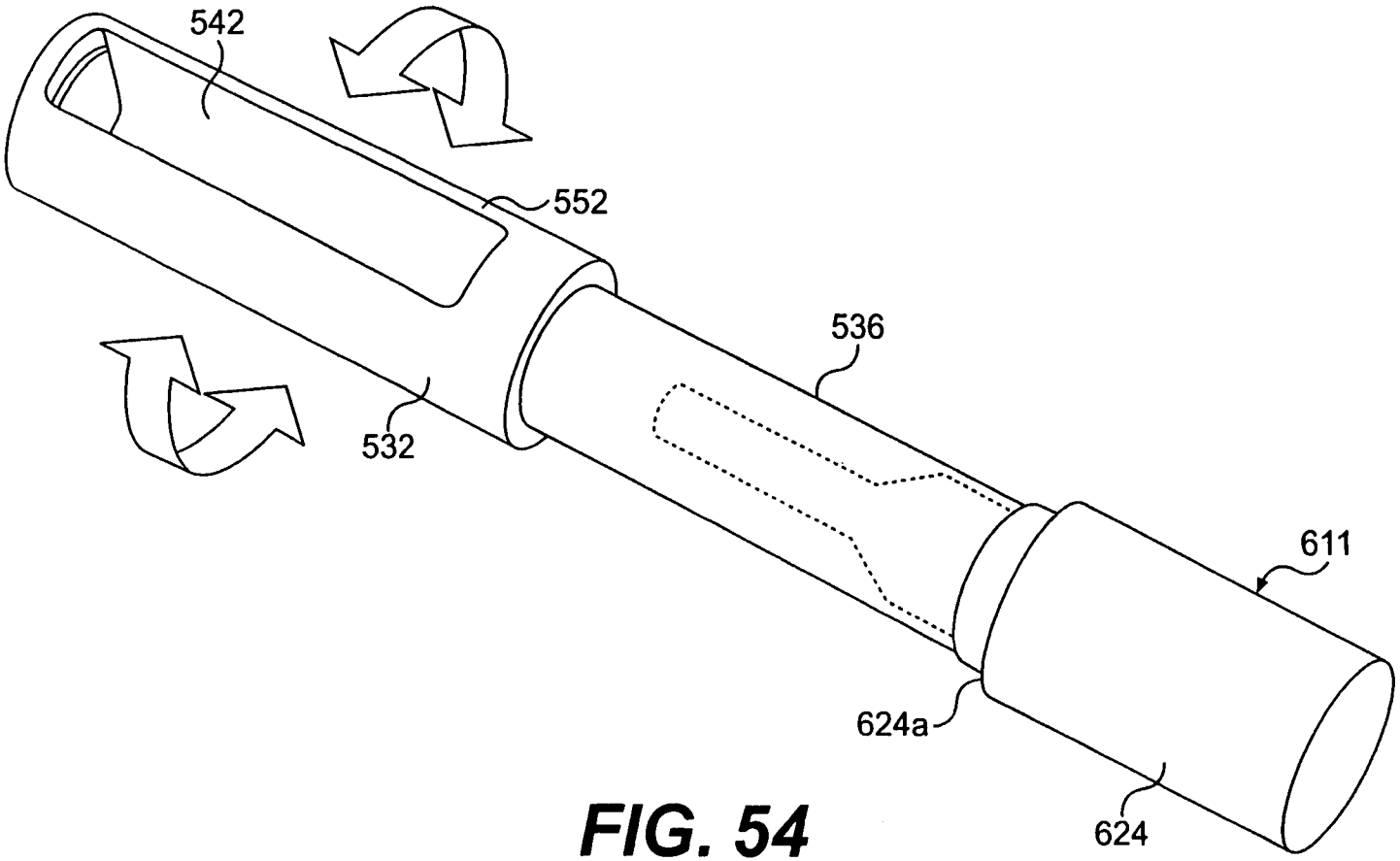
FIG. 54 is a perspective view of another embodiment of the dispenser of the invention.
Figure 55A:
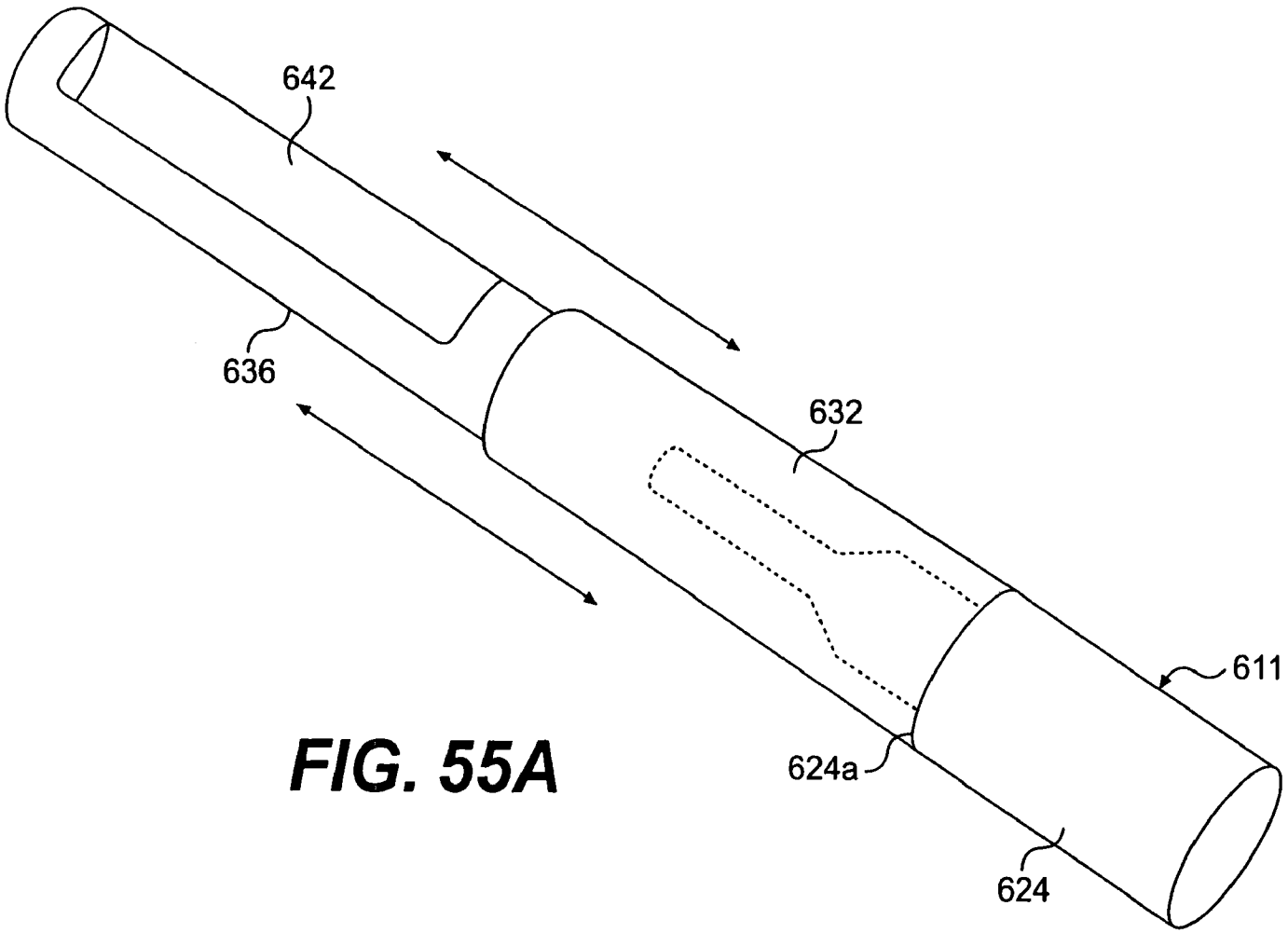
FIGS. 55A and 55B are perspective views of a still further embodiment, shown in open and closed positions, respectively.
Figure 55B:
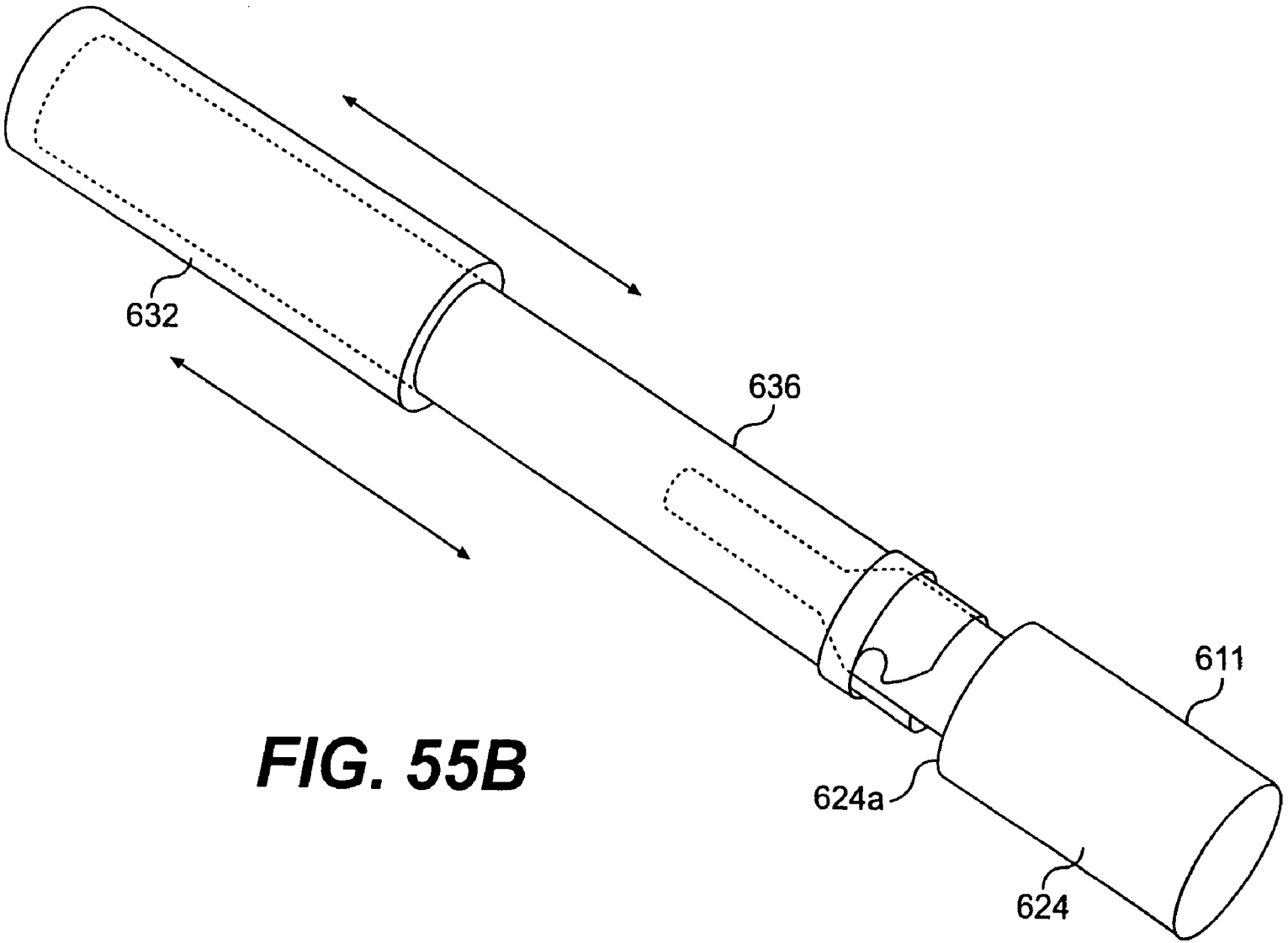

FIGS. 54 and 55A–55B illustrate two embodiments of the dispenser of the invention each having an inner member generally as described with reference to FIGS. 20–48 above, and a base cap with an axial length which is only about half that of the inner member. In FIG. 54, the base cap 532 is rotatably mounted in surrounding relation to the distal portion of the inner member 536, which includes a laterally open pocket 542 for material to be dispensed. Base cap 532 has a window 552 for register with the opening of pocket 536, so that rotation of the base cap relative to the inner member turns the base cap between positions in which it closes and opens the pocket. In FIGS. 55A–55B, the base cap 632 is axially slidable along the inner member 636, which has a laterally opening pocket 642 in its distal portion, between an open position (FIG. 55A) in which the base cap exposes the pocket and a closed position (FIG. 55B) in which it covers the pocket. The applicator units 611 of both embodiments are shown as having caps 624 with skirt portions 624*a* that laterally surround and outwardly overlie nibs (not shown) corresponding to nibs 130 of applicator unit 111 described above.

In each of the above-described illustrative embodiments of the invention, a unitary dispenser, sized to be conveniently carried in a purse or pocket, includes a coherent body of cosmetic material (e.g. lip colorant), a brush for precisely applying the material to a selected region of a user's face, and structure for fully enclosing both the brush and the cosmetic material to shield them (and to prevent them from marking or staining clothing or other objects) between applications of the material. The brush is securely but removably received within a well, and the receptacle/reservoir containing the cosmetic material is securely but openably covered. For application of the material, the user manually removes the brush from the well, manually opens the receptacle/reservoir, picks up cosmetic material therefrom, and applies it to a selected facial region. When the application is complete, the receptacle is closed, the brush is returned to its well, and the dispenser may be returned to pocket or purse.

It is to be understood that the invention is not limited to the features and embodiments herein specifically set forth, but may be carried out in other ways without departure from its spirit.

What is claimed is:

1. A dispenser for material which is in the form of a coherent body and is to be applied to a surface, comprising:

(a) a manipulable applicator unit including an applicator for the material; and (b) a material container unit having proximal and distal ends and comprising an assembly including (i) a well, opening through the proximal end of the unit, in which the applicator is removably insertable, for storing and shielding the applicator;

(ii) a receptacle with an open side, disposed distally of the well and opening laterally of the unit, for holding a coherent body of the material; and (iii) a cover manually movable relative to the receptacle for opening and closing the receptacle, the receptacle when open providing access for the applicator to be brought into contact with material of the coherent body, said container unit having a geometrical axis, said well being shaped and positioned such that said applicator and said receptacle are disposed in tandem along said geometrical axis of the container unit when said applicator is stored in said well, and said cover and said receptacle being relatively rotatable about or relatively slidable along said geometrical axis of the container unit to open and close the receptacle;

wherein the container unit includes a housing member having a proximal portion and a distal portion, wherein the distal portion of the housing member has a side wall with a lateral opening formed therein, wherein at least the distal portion of the housing member is hollow, and wherein the receptacle is disposed within the hollow distal portion of the housing member so as to be manually rotatable relative thereto to move the open side of the receptacle into and out of register with the lateral opening of the housing member.

2. A dispenser as defined in claim 1, wherein the well is formed in the proximal portion of the housing member, and the receptacle has a manually graspable portion to enable manual rotation of the receptacle relative to the housing member.

3. A cosmetics package comprising a dispenser as defined in claim 1 and a coherent body of material disposed in the receptacle thereof.

4. A cosmetics package as defined in claim 3, wherein said applicator is a brush and said material is lip colorant.

* * * * *